US006609962B1

(12) United States Patent
Wakabayashi et al.

(10) Patent No.: US 6,609,962 B1
(45) Date of Patent: Aug. 26, 2003

(54) DRESSING APPARATUS AND POLISHING APPARATUS

(75) Inventors: Satoshi Wakabayashi, Tokyo (JP); Kuniaki Yamaguchi, Tokyo (JP); Tetsuji Togawa, Tokyo (JP); Nobuyuki Takada, Tokyo (JP); Osamu Nabeya, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/572,629

(22) Filed: May 17, 2000

(30) Foreign Application Priority Data

May 17, 1999 (JP) ..... 11-136087
Apr. 7, 2000 (JP) ..... 2000-107011

(51) Int. Cl.[7] ..... B24B 1/00
(52) U.S. Cl. ..... 451/443; 451/56; 451/444
(58) Field of Search ..... 451/443, 287, 451/288, 56, 444, 268, 269, 21, 72

(56) References Cited

U.S. PATENT DOCUMENTS 5,036,015 A 7/1991 Sandhu et al. ..... 438/14
5,743,784 A * 4/1998 Birang et al. ..... 451/21
5,755,614 A * 5/1998 Adams et al. ..... 134/902
5,827,112 A * 10/1998 Ball ..... 125/11.22
5,830,041 A * 11/1998 Takahashi et al. ..... 451/8
5,833,519 A 11/1998 Moore ..... 451/56
5,839,947 A * 11/1998 Kimura et al. ..... 451/288
5,851,136 A 12/1998 Lee ..... 451/9
5,885,147 A * 3/1999 Kreager et al. ..... 451/324
5,897,425 A * 4/1999 Fisher et al. ..... 451/41
5,958,794 A * 9/1999 Bruxvoort et al. ..... 216/88
5,961,372 A * 10/1999 Shendon ..... 451/299
6,083,085 A * 7/2000 Lankford ..... 451/56
6,093,080 A * 7/2000 Inaba et al. ..... 451/5
6,126,523 A * 10/2000 Moriyasu et al. ..... 451/56
6,139,404 A * 10/2000 Yau ..... 451/443
6,213,856 B1 * 4/2001 Cho et al. ..... 451/443
6,270,396 B1 * 8/2001 Uchiyama ..... 451/56
6,306,025 B1 * 10/2001 Torii ..... 451/443
6,312,319 B1 * 11/2001 Donohue et al. ..... 451/56
6,328,637 B1 * 12/2001 Labunsky et al. ..... 451/443

FOREIGN PATENT DOCUMENTS

EP 0566258 A1 10/1993 ..... B24D/3/34
EP 0764478 A1 3/1997 ..... B08B/1/04
EP 0787561 A1 8/1997 ..... B24B/37/04
JP 11077534 A * 3/1999 ..... B24B/53/00
WO 98/45090 10/1998

* cited by examiner

*Primary Examiner*—Joseph J. Hail, III
*Assistant Examiner*—David B. Thomas
(74) *Attorney, Agent, or Firm*—Wenderoth, Lind & Ponack, L.L.P.

(57) ABSTRACT

A dressing apparatus is used for dressing a polishing surface of a polishing table used for polishing a workpiece such as a semiconductor wafer. The dressing apparatus for dressing apparatus comprises a dresser having a dressing surface for dressing the polishing surface, and the dressing surface has an area which covers an entire area of the polishing surface.

23 Claims, 28 Drawing Sheets

DRESSING APPARATUS AND POLISHING APPARATUS

BACKGROUND OF THE INVENTION

1. Field of the Invention

The present invention relates to a dressing apparatus for dressing a polishing surface of a polishing table used for polishing a workpiece in a polishing apparatus, and a polishing apparatus having such dressing apparatus for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus for performing Chemical Mechanical Polishing (CMP).

Conventionally, as shown in FIG. 43, such a polishing apparatus has a polishing table 102 having a polishing cloth (polishing pad) 100 attached to the upper surface thereof, and a top ring 104 for holding a substrate W such as a semiconductor wafer and pressing the substrate W against the polishing cloth 100 on the polishing table 102. A polishing liquid containing abrasive particles is supplied from a nozzle 106 onto the polishing cloth 100 and retained on the polishing cloth 100. The polishing cloth 100 on the polishing table 102 constitutes a polishing surface. During operation, the top ring 104 exerts a certain pressure, and the surface of the substrate W held against the polishing surface of the polishing table 102 is therefore polished to a flat mirror finish while the top ring 104 and the polishing table 102 are rotating. The polishing liquid comprises abrasive particles such as silica particles, and chemical solution such as alkali solution in which the abrasive particles are suspended. Thus, the substrates W is chemically and mechanically polished by a combination of a mechanical polishing action of abrasive particles in the polishing liquid and a chemical polishing action of chemical solution in the polishing liquid.

When the polishing process is finished, the polishing capability of the polishing cloth 100 is gradually deteriorated due to a deposition of the abrasive particles and ground-off particles removed from the substrate, and due to changes in the characteristics of the surface of the polishing cloth. Therefore, if the same polishing cloth is used to repeatedly polish the substrates W, the polishing rate of the polishing apparatus is lowered, and the polished substrates tend to suffer polishing irregularities. Therefore, it has been customary to condition the polishing cloth according to a process called "dressing" for recovering the surface of the polishing cloth before, or after, or during polishing.

In order to dress the surface of the polishing cloth 100 which has been deteriorated by polishing, a dressing apparatus 108 having a dressing surface is provided adjacent to the polishing table 102. In operation, the dressing surface of the dressing apparatus 108 is pressed against the polishing surface of the polishing table 102, and the dressing surface and the polishing table 102 are rotated relatively to each other for thereby bringing the dressing surface in sliding contact with the polishing surface. Thus, the polishing liquid and the ground-off particles attached to the polishing surface are removed, and planalization and regeneration of the polishing surface are conducted.

In order to primarily remove the polishing liquid and the ground-off particles from the polishing surface, the dressing apparatus 108 having a dressing surface composed of a nylon brush is mainly used. In order to primarily planalize the polishing surface by scraping off the polishing surface slightly, the dressing apparatus 108 having a diamond dresser is mainly used. The uniformity of the polishing surface which has been dressed affects greatly polishing precision of the workpiece.

However, the above-mentioned polishing apparatus has the following problems:

The first problem is that in case of polishing a substrate by a polishing table which rotates on its own axis, there is no relative movement between the polishing surface and the substrate on the rotation center of the polishing table, and hence the substrate is polished on an area of the polishing surface away from the rotation center of the polishing table. Therefore, the diameter of the polishing table 102 should be at least two times the diameter of the substrate W. Thus, the size of the polishing apparatus becomes large, and a large installation space of the polishing apparatus is required and the cost of facilities is high. This drawback is becoming significant with increasing diameter of the substrate W.

The second problem is presented by the polishing cloth 100 made of material having elasticity such as urethane. In general, a device pattern on the upper surface of the semiconductor wafer (substrate) W has various irregularities having various dimensions and steps, and is composed of different material. When the semiconductor wafer W having step-like irregularities is planarized by the polishing cloth 100 having elasticity, not only raised regions but also depressed regions are polished, and hence a large amount of material is removed from the semiconductor wafer and a long period of time is required until the semiconductor wafer is planarized. Thus, the operation cost in the polishing process is increased and irregularities of the polished surface of the semiconductor wafer are difficult to be eliminated, with the result that a high flatness of the polished surface cannot be obtained.

Further, regions on which microscopic irregularities are concentrated are polished at a high polishing rate, and regions on which macroscopic irregularities exist are polished at a low polishing rate. Thus, a large undulation is formed on the polished surface of the semiconductor wafer.

The third problem is presented by operating cost in the polishing process and environmental pollution. In order to polish the semiconductor wafer to a high degree of flatness, a polishing liquid needs to be supplied abundantly onto the polishing cloth 100. However, the supplied polishing liquid is discharged from the polishing cloth 100 at a high rate without being used in an actual polishing process. This leads to a high operating cost in the polishing process because the polishing liquid is expensive. Further, since the polishing liquid contains a large amount of abrasive particles such as silica particles, and may contain chemicals such as acids or alkalis to thus form slurry-like material, it is necessary to treat waste liquid discharged from the polishing process for thereby preventing environmental pollution. This also leads to a high operating cost in the polishing process.

In order to solve the first problem, it is conceivable that the polishing apparatus incorporates the polishing table 102 which makes a circulative translational motion (scroll motion) along a circle having a certain radius. In this case, every point on the polishing surface of the polishing table makes the same motion, and hence the diameter of the polishing surface on the polishing table may be equal to the dimension obtained by adding two times radius of gyration of the polishing table 102 to the diameter of the semiconductor wafer (substrate).

Thus, the polishing apparatus may be small in size and the installation space of the polishing apparatus may be reduced to lower the overall cost including manufacturing cost of the polishing apparatus, operating cost in the plant and cost of equipment.

In order to solve the second and third problems, it is conceivable to polish the semiconductor wafers (substrates) by the use of an abrading plate. The abrading plate comprises abrasive particles such as silica particles and a binder for binding the abrasive particles, and is formed into a flat plate. The abrading plate may be called a fixed abrasive plate. The abrading plate is attached to the upper surface of the polishing table, and the semiconductor wafer W held by the top ring 104 is pressed against the abrading plate under a certain pressure and brought in sliding contact with the abrading plate. With the sliding contact between the abrading plate and the semiconductor wafer, the semiconductor wafer is polished while the binder is broken or dissolved to thus generate fresh freed abrasive particles.

According to the above polishing process, the abrading plate is harder than the polishing cloth and has less elastic deformation than the polishing cloth, and hence only the raised regions on the semiconductor wafer are polished and undulation of the polished surface of the semiconductor wafer is prevented from being formed. Further, since a slurry-like polishing liquid containing a large amount of abrasive particles is not used, the amount of wastes discharged from the polishing process and required to be treated is greatly reduced, and hence the operating cost is reduced and environmental protection is easily carried out. Since the polishing liquid containing abrasive particles is not used, equipment for supplying the polishing liquid is not required.

In the case where the abrading plate is attached to the polishing table which makes a circulative translational motion (scroll motion) and the substrate is polished by the abrading plate, the polishing surface of the abrading plate includes a central region which is always brought in contact with the substrate, a peripheral region which is always brought out of contact with the substrate, and an intermediate region which is brought in contact or out of contact with the abrading plate. As a result, as shown in FIG. 9A, the surface of the abrading plate 16, i.e., the polishing surface 16*a* has a depressed region. That is, the central region A of the polishing surface suffers a large abrasion loss, the peripheral region C suffers hardly any abrasion loss, and the intermediate region B suffers an inclined abrasion loss. Even if the substrate (semiconductor wafer) continues to be polished by the polishing surface shown in FIG. 9A, the substrate cannot be planarized. Thus, it is necessary to dress the polishing surface of the abrading plate.

In such a case, if dressing of the polishing surface is conducted by a dressing tool having a circular dressing surface or an annular dressing surface smaller than the polishing surface as in the case of conventional dressing process, then the polishing surface of the abrading plate having irregularities is locally dressed, and hence it is difficult to planarize the entire area of the polishing surface. These circumstances hold true for the dressing process of the polishing surface composed of the polishing cloth attached to the polishing table which makes a circulative translational motion (scroll motion).

In order to prolong a service life of the abrading plate or the polishing cloth, it is necessary not to conduct more dressing operations than necessary. It has been customary to determine an end point of dressing operation on the basis of average dressing time obtained by operational experience.

However, since proper dressing time is changed depending on the number of times the polishing tool has been used, the number of times the polishing surface has been dressed, and the like, the proper dressing amount cannot be obtained by the above conventional method, resulting in excessive or insufficient dressing operation.

Further, the dressing surface of the dressing apparatus generally comprises a single dresser element such as a sponge, a brush, or an electrodeposited diamond plate, and it is difficult to form the dressing surface by combination of a plurality of dresser elements. A cleaning process of the polishing cloth is conducted separately from the dressing process, and cannot functionally take the place of the dressing process.

Although the dresser element on a standby condition has been immersed in a cleaning liquid such as pure water in a dresser cleaning container to prevent the dresser element from drying, cleaning of the dresser element has not been conducted. Thus, foreign matter attached to the dresser element or fragments of the dresser element are attached to the polishing surface to cause a polished surface of the substrate to be scratched, resulting in impairing the polishing performance.

SUMMARY OF THE INVENTION

It is therefore an object of the present invention to provide a dressing apparatus which can easily and reliably planarize a polishing surface having irregularities and regenerate the polishing surface efficiently.

Another object is to provide a dressing apparatus which can dress a polishing surface of a polishing table, which makes a circulative translational motion (scroll motion or circulative orbital motion) and has an advantage of a small installation space, by a dresser which requires a small installation space, and can increase a processing capability of the polishing table per unit installation area.

Still another object is to provide a dressing apparatus which can easily install a plurality of dresser elements and use dresser elements composed of different materials which can be freely combined, and can increase a dressing capability.

Still another object is to provide a dressing apparatus having a dresser element which can be cleaned in a dresser cleaning container to prevent foreign matter attached to the dresser element or fragments of the dresser element from being attached to a polishing surface of a polishing table.

According to a first aspect of the present invention, there is provided a dressing apparatus for dressing a polishing surface of a polishing table for polishing a surface of a workpiece, the dressing apparatus comprising: a dresser having a dressing surface for dressing the polishing surface, the dressing surface having an area which covers an entire surface of the polishing surface.

According to the dressing apparatus of the present invention, the entire area of the polishing surface can be simultaneously dressed by bringing the dressing surface in contact with the polishing surface and making a relative motion between the dressing surface and the polishing surface, and hence the polishing surface of the polishing table can be efficiently and uniformly regenerated over its entire area.

Material such as abrasive particles capable of dressing the polishing surface may be uniformly attached to a substantially entire surface of the dressing surface, or may be dispersively attached to the dressing surface to form a certain pattern. Thus, while the polishing table makes, for example, a circulative translational motion, the polishing surface of the polishing table can be dressed uniformly by the dressing surface.

The material capable of dressing the polishing surface may comprise particles such as diamond particles, ceramics such as SiC, or a brush. Particles such as diamond particles are attached to the dresser body by electrodeposition. A sheet to which particles such as diamond particles are attached by adhesion may be attached to the dressing surface. Further, the dressing surface may comprise an abrading plate or a polishing cloth. The brush may comprise synthetic resin such as nylon, or natural material.

According to a second aspect of the present invention, there is provided a dressing apparatus for dressing a polishing surface of a polishing table for polishing a surface of a workpiece, the dressing apparatus comprising: a dresser having a dressing surface for dressing the polishing surface; a sensor for detecting a frictional load between the polishing surface and the dressing surface directly or indirectly; and a judgement device for judging whether dressing of the polishing surface progresses to a predetermined degree on the basis of an output of the sensor.

When the polishing surface having irregularities is planarized with progress of dressing, the frictional force between the polishing surface and the dressing surface is changed, and current of a motor for rotating the dresser or the polishing table, or torque for rotating the dresser or the polishing table is changed. Thus, by detecting the change of current or torque, progress of dressing of the polishing cloth may be judged.

According to a third aspect of the present invention, there is provided a dressing apparatus for dressing a polishing surface of a polishing table for polishing a surface of a workpiece, the dressing apparatus comprising: a dresser having a dressing surface for dressing the polishing surface; a dresser cleaning container containing a cleaning liquid and having an upper open end; and a device for supplying the cleaning liquid to the container; wherein a content volume of the container is 1.5 to 2.5 times larger than a volume of an immersed part of the dresser immersed in the cleaning liquid in the container.

With the above arrangement, the dresser is cleaned in the dresser cleaning container, and foreign matter attached to the dresser element or fragments of the dresser element such as diamond particles are removed from the dresser, thus eliminating harmful influence caused by them on the polishing surface.

According to a forth aspect of the present invention, there is provided a dressing apparatus for dressing a polishing surface of a polishing table for polishing a surface of a workpiece, the dressing apparatus comprising: a dresser having a dressing surface for dressing the polishing surface, the dressing surface having a dimension in one direction which is longer than a dimension in the direction of a moving area of the polishing surface; and a moving mechanism for moving the dresser horizontally along the polishing surface.

In case of a rectangular dresser, the size of the dresser in the long side must have the dimension equal to or larger than that of the moving area of the polishing table, i.e., the dimension obtained by adding a scroll diameter to a diameter of the polishing table. However, the size of the dresser in the short side may be as small as possible, provided that the dressing condition permits. Thus, the rectangular dresser can save an installation space, compared with the circular dresser.

The horizontally moving mechanism may comprise a translation mechanism for causing the dresser to perform a translation along the polishing surface. With this structure, relative vectors on contact surface between the dressing surface and the polishing surface which makes a scroll motion are equalized over the entire polishing surface, and contact time between the dressing surface and the polishing surface is equalized over the entire polishing surface, and hence uniform dressing can be performed.

The dresser may comprise a cylindrical roller which rotates about an axis parallel to said polishing surface and has a dressing surface on its outer circumferential surface.

According to a fifth aspect of the present invention, there is provided a dressing apparatus for dressing a polishing surface of a polishing table for polishing a surface of a workpiece, the dressing apparatus comprising: a dresser having a dressing surface for dressing the polishing surface, the dresser performing no rotational motion about its own axis during dressing.

In a preferred aspect, the dressing surface comprises a plurality of dresser elements. In this case, a hard dresser element such as diamond particles is attached to the dresser body by electrodeposition, and a soft dresser element such as a nylon brush is provided on the dresser body. Then, a plurality of dressing elements including the hard dresser element and the soft dresser element are juxtaposed to form an integral dresser. This integral dresser is moved in one direction to dress the entire area of the polishing surface, thus making good use of characteristics of respective dresser elements and performing an effective dressing.

In a preferred aspect, a dresser cleaning container is provided to clean the dressing surface by supplying a cleaning liquid to the dresser cleaning container. If the dresser cleaning container is formed into an elongate shape so as to correspond to the shape of the rectangular dresser, the dresser cleaning container can save its installation space. Further, foreign matter attached to the dresser element or fragments of the dresser element such as diamond particles are removed from the dresser, thus eliminating harmful influence caused by them on the polishing surface.

In a preferred aspect, a limiting mechanism is provided to limit a lifting motion of the dresser.

In a preferred aspect, a cleaning mechanism which has an ultrasonic cleaning device or a cavitation generating device is provided on the dresser.

In a preferred aspect, a dresser cleaning container is provided for cleaning the dressing surface of the dresser using the cleaning mechanism.

In a preferred aspect, there is provided a prevention mechanism for preventing the dresser from falling out of the polishing table.

With the above arrangement, when a hard dressing surface of the dresser is pressed against the polishing surface to dress the entire polishing surface, the dresser is prevented from falling out of the polishing table, and thus from colliding with the side of the polishing table which makes a scroll motion, thus avoiding damage of the dresser or other components.

The prevention mechanism may comprise the following:

1) A guide table for supporting the portion of the dresser which projects from the polishing table is provided to prevent the dresser from falling out of the polishing table.

2) A detecting device for detecting the position of the dresser is provided to detect whether the dresser reaches an area which is located outside the polishing table and in which the dresser is prevented from falling. The detecting device may comprise a position detecting sensor attached to the dresser, e.g., the horizontal moving shaft of the dresser, or the number of pulses of a motor such as a stepping motor, or the like.

In case of 1), in order to press the polishing surface uniformly and allow the dresser to be transferred smoothly between the guide table and the polishing table, an upper surface comprising the same kind of material as the polishing table is provided on the guide table, and is flush with the polishing surface of the polishing table to equalize the amount of material removed from the polishing surface of the polishing table and the upper surface of the guide table. Further, if a polishing liquid is supplied to the polishing table, then the same polishing liquid is supplied to the guide table.

In a preferred aspect, a control mechanism is provided to control a pressing amount of the dresser against the polishing surface of the polishing table.

If a pressure of the dresser against the polishing table is controlled by a pressing force of the dresser, then in case of a soft dressing element, a small change of the pressure of the dresser against the polishing table causes the dresser element to be deformed excessively, thus making it difficult to control the pressure of the dresser. Further, an area of the polishing surface is changed with progress of a dressing process, and the pressure applied to the polishing surface is changed to cause nonuniform dressing. However, in the present invention, the positional relationship between the polishing surface and the dresser is controlled to be constant, thus preventing nonuniform dressing to be caused.

According to other aspects of the present invention, there is provided a polishing apparatus having the dressing apparatus with the above-mentioned structure.

DETAILED DESCRIPTION OF THE PREFERRED EMBODIMENTS

Next, a dressing apparatus and a polishing apparatus according the present invention will be described below with reference to drawings.

FIGS. 1 through 6 show a polishing apparatus having a dressing apparatus according to a first embodiment of the present invention.

Figure 1:
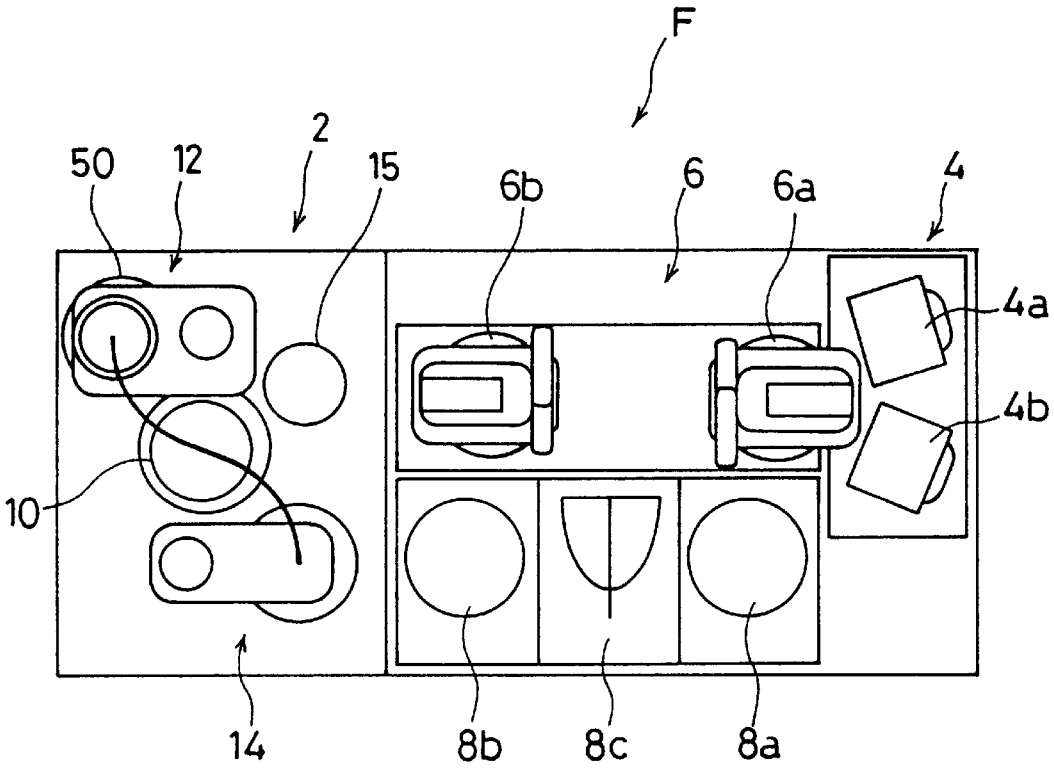
FIG. 1 is a plan view showing a polishing apparatus having a dressing apparatus according to a first embodiment of the present invention.

As shown in FIG. 1, the polishing apparatus comprises a polishing unit 2 positioned at one end of a rectangular floor space F, and a loading and unloading unit 4 positioned at the other end of the rectangular floor space F and having wafer cassettes 4*a*, 4*b* thereon. Between the polishing unit 2 and the loading and unloading unit 4, there are provided a transfer unit 6 comprising two transfer robots 6*a* and 6*b*, cleaning units 8*a* and 8*b*, and a reversing unit 8*c*.

In the polishing unit 2, there are provided a polishing table 10, and a top ring unit 12 and a dressing unit 14 which are arranged in such a manner that the polishing table 10 is located between the top ring unit 12 and the dressing unit 14. The transfer robot 6*b* and a pusher 15 for transferring a substrate W to and from the top ring unit 12 are provided laterally of the polishing table 10.

Figure 2:
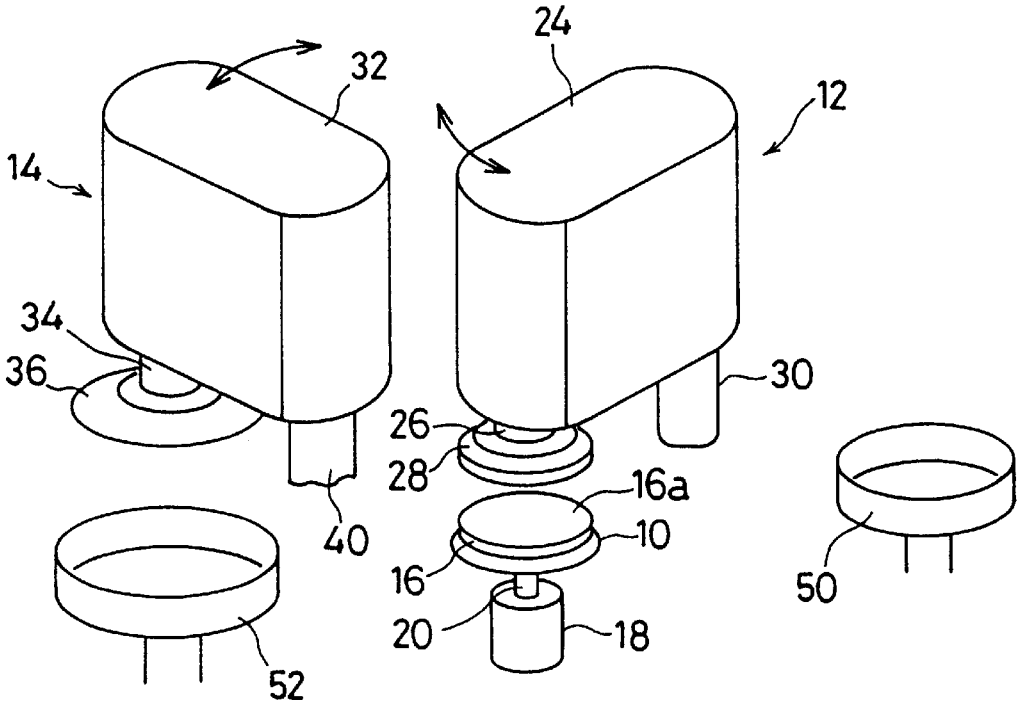
FIG. 2 is a perspective view showing essential parts of the polishing apparatus according to the first embodiment of the present invention.

As shown in FIG. 2, a top ring cleaning container 50 and a dresser cleaning container 52 are provided at respective standby positions of the top ring unit 12 and the dressing unit 14.

Figure 3:
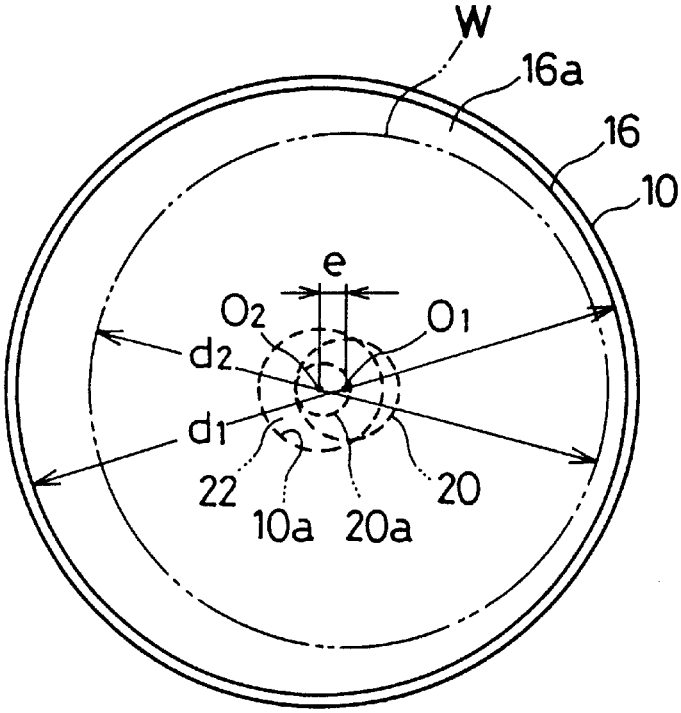
FIG. 3 is a plan view of a polishing table shown in FIG. 2.
Figure 4:
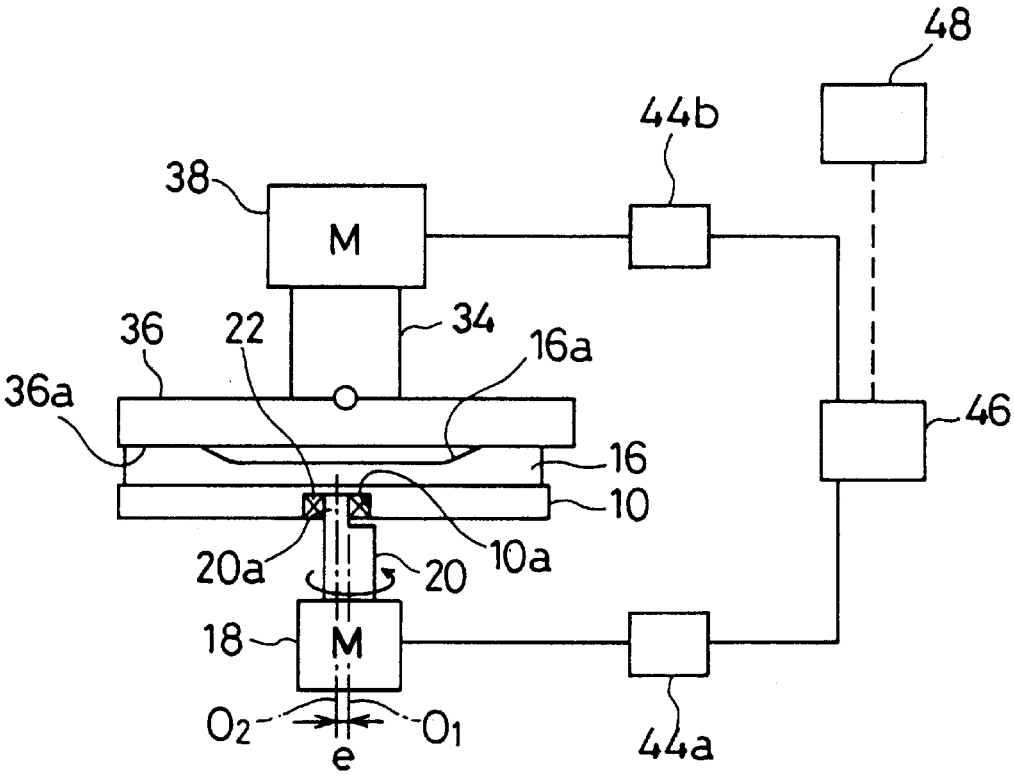
FIG. 4 is a cross-sectional view showing the manner in which a polishing surface is dressed in the polishing apparatus shown in FIG. 1.

An abrading plate 16 formed into a circular thin disk is attached to the upper surface of the polishing table 10, and a flat polishing surface 16*a* is formed on the surface of the abrading plate 16. The abrading plate 16 constitutes a polishing tool. A motor 18 is disposed below the polishing table 10, and as shown in FIGS. 3 and 4, a drive shaft 20 of the motor 18 has an upper end on which a drive pin 20*a* is provided. A central axis $O_1$ of the drive shaft 20 is spaced from a central axis $O_2$ of the drive pin 20*a* by "e". The polishing table 10 has a lower surface in which a recess 10a for receiving the drive pin 20*a* therein through a bearing 22 is formed. The polishing table 10 is supported by a support mechanism (not shown) in such a manner that the polishing table 10 is restrained so as not to rotate about the drive pin 20*a*.

Thus, when the drive shaft 20 is rotated by energizing the motor 18, the drive pin 20*a* makes a rotational motion along a circle having a radius "e", and the polishing table 10 makes a circulative translational motion (scroll motion) along a circle having a radius "e" without rotating on its own axis. The diameter $d_1$ of the polishing surface 16*a* is equal to or larger than the dimension obtained by adding two times eccentricity "e" to the diameter $d_2$ of the substrate W. Therefore, the diameter $d_1$ of the polishing surface 16*a* is expressed as follows:

$$d_1 \geqq d_2 + 2e$$

Thus, the entire surface of the substrate W can be polished at the same time. For example, if the diameter $d_2$ of the substrate W is 200 mm and the eccentricity "e" is 10 mm, then the diameter $d_1$ of the polishing surface 16*a* is set to 240 mm. In case of using a scroll-type polishing table, the diameter of the polishing table is not required to be equal to or larger than two times the diameter of the semiconductor wafer (substrate) as in the conventional rotating-type polishing table.

The abrading plate 16 comprises abrasive particles and a binder for binding the abrasive particles. The abrasive particles are dispersed in the binder. As the polishing operation progresses, the abrasive particles are separated from the binder to thus generate fresh freed abrasive particles. A supply device for supplying a certain polishing liquid is provided to remove frictional heat generated on the polishing surface 16*a*, to remove ground-off material removed from the substrate, and to accelerate separation of the abrasive particles. Since relative movement between the polishing table 10 and the substrate W is relatively small, the polishing liquid is supplied to the polishing surface 16*a* through internal passages formed in the abrading plate 16.

As shown in FIG. 2, the top ring unit 12 comprises a top ring head housed in a top ring cover 24, a top ring shaft 26 supported by the top ring head, and a top ring 28 attached to the lower end of the top ring shaft 26 and having a substantially disk-like shape. Thus, the substrate W is held under vacuum and pressed against the polishing surface 16*a* under a certain pressure by the top ring 28. A motor, a swing arm, an air cylinder, and the like (not shown) are provided in the interior of the top ring cover 24. The base portion of the swing arm is connected to an upper end of a support shaft 30 which extends vertically and is rotatable about its own axis. The free end of the swing arm supports the top ring shaft 26 so that the top ring shaft 26 is vertically movable and rotatable about its own axis. Thus, the swing arm is horizontally swung together with the top ring cover 24 by rotation of the support shaft 30, and the top ring shaft 26 and the top ring 28 are rotated and vertically moved integrally by energizing the motor and actuating the air cylinder.

The dressing unit 14 comprises a dressing cover 32, a dressing head housed in the dressing cover 32, a dresser shaft 34 supported by the forward end of the dressing head, and a dresser 36 attached to the lower end of the dresser shaft 34.

A motor 38 (see FIG. 4), a swing arm (not shown) and an air cylinder (not shown) are provided in the interior of the dressing cover 32. The base portion of the swing arm is connected to an upper end of a support shaft 40 which extends vertically and is rotatable about its own axis. The free end of the swing arm supports the dresser shaft 34 so that the dresser shaft 34 is vertically movable and rotatable about its own axis. Thus, the swing arm is horizontally swung together with the dressing cover 32 by rotation of the support shaft 40, and the dresser shaft 34 and the dresser 36 are rotated and vertically moved integrally by energizing the motor 38 and actuating the air cylinder.

Figure 5:
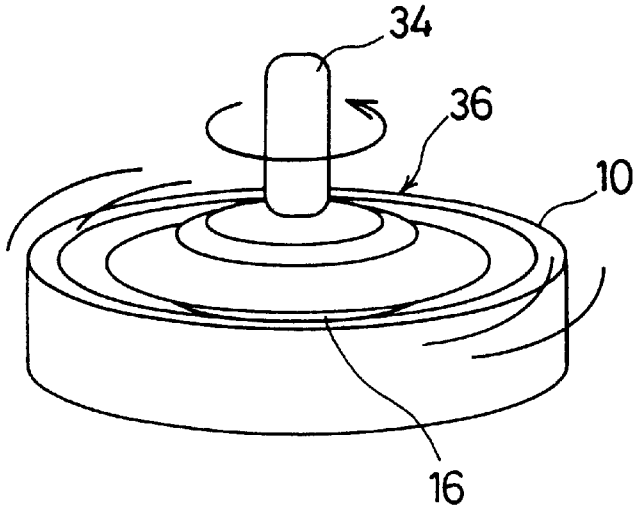
FIG. 5 is a perspective view showing the manner in which the polishing surface is dressed in the polishing apparatus shown in FIG. 1.

As shown in FIG. 5, the dresser 36 has a substantially circular plate whose diameter increases gradually in a downward direction to have a downwardly expanding profile.

Figure 6A:
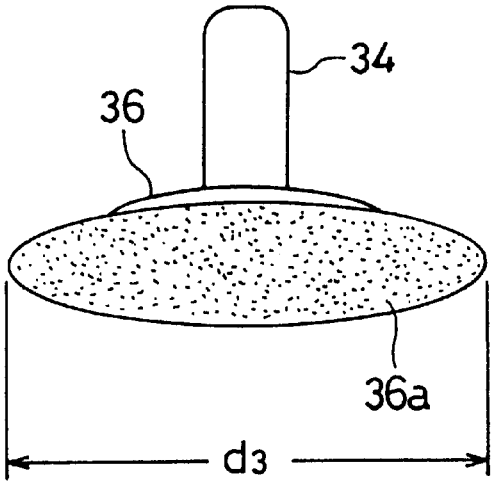
FIGS. 6A and 6B are perspective views of dressers having a different shape, respectively.

As shown in FIG. 6A, the lower surface of the dresser 36 has a flat dressing surface 36 whose size is set to cover the entire moving area of the polishing surface 16*a*. Specifically, if the diameter $d_1$ of the polishing surface 16*a* is 240 mm and the eccentricity "e" is 10 mm, then the diameter $d_3$ of the dressing surface 36*a* is set to be equal or larger than the dimension obtained by adding two times eccentricity "e" to the diameter $d_1$ of the polishing surface 16*a*, i.e., $d_3 \geqq d+2e=260$ mm. In this example, the diameter $d_3$ of the dressing surface 36*a* is set to 270 mm.

Figure 6B:
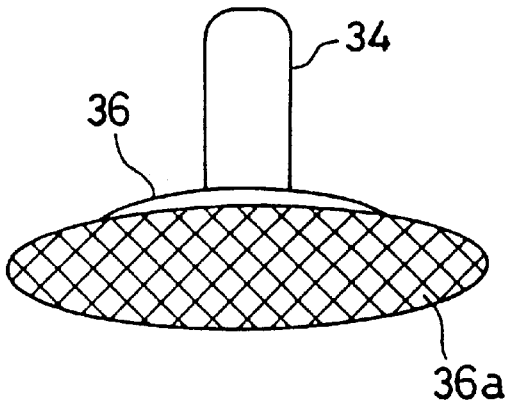
Figure 7A:
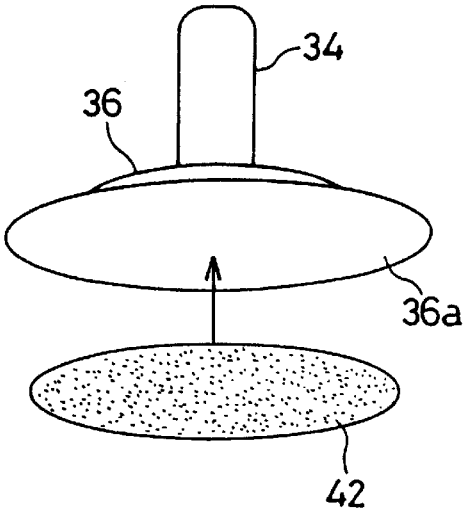
FIGS. 7A and 7B are perspective views of a dresser in another embodiment.
Figure 7B:
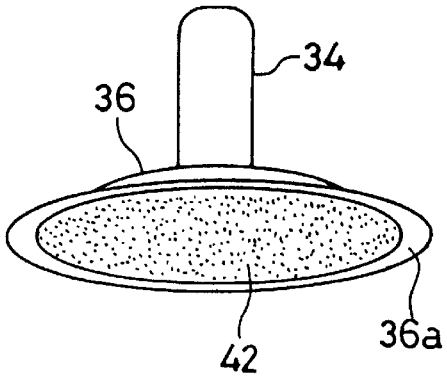

Diamond particles capable of dressing or conditioning the polishing surface are uniformly attached to the entire surface of the dressing surface 36*a* by electrodeposition. The diamond particles may be attached to the dressing surface 36*a* by electrodeposition in a lattice pattern, as shown in FIG. 6B. Further, a diamond sheet 42 having diamond particles at one side by adhesion is prepared as shown in FIG. 7A, and then the diamond sheet 42 is attached to the dressing surface 36*a* of the dresser 36 as shown in FIG. 7B.

Figure 8:
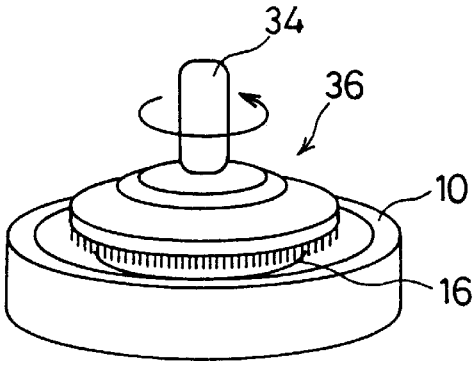
FIG. 8 is a perspective view of a dresser in still another embodiment.

The use of the diamond sheet 42 offers the advantages that the diamond sheet 42 can flexibly deal with the shape and dimension of the polishing surface, and when the dressing surface is worn away, only the diamond sheet 42 can be replaced with new one without replacing the whole dresser. Further, instead of diamond particles, other particles may be used, or ceramics such as SiC may be used. Further, the dressing surface of the dresser 36 may be formed by a brush as shown in FIG. 8.

In this embodiment, a judgement device for judging whether dressing of the polishing surface progresses to a desired degree is provided. The judgement device has a simple structure. Specifically, as shown in FIG. 4, a motor current detector 44*a* is provided to detect motor current of the motor 18 for rotating the drive shaft 20 of the polishing table 10, and a motor current detector 44*b* is provided to detect motor current of the motor 38 for rotating the dresser shaft 34 of the dresser 36. The motor current detectors 44*a*, 44*b* generate respective signals, indicative of respective torques in the polishing table 10 and the dresser 36, which are inputted into a signal processing device 46. The signal processing device 46 is connected to a controller 48 for controlling overall operations of the polishing apparatus. The detection of torque may be sufficient in either of the polishing table 10 and the dresser 36.

Next, operation of the polishing apparatus will be described below.

First, the motor 18 is energized to cause the polishing table 10 to make a circulative translational motion (scroll motion). Then, the substrate W is held by the top ring 28 under vacuum, and is lowered to contact the polishing surface 16*a* of the polishing table 10 while the substrate W and the top ring 28 are rotated.

The substrate W is pressed against the polishing surface 16*a* of the polishing table 10 to polish the substrate W. The polishing liquid is supplied to the polishing surface 16*a* through the internal passages of the abrading plate 16. While the substrate W is polished, the binder is broken or dissolved to generate fresh freed abrasive particles.

Figure 9A:
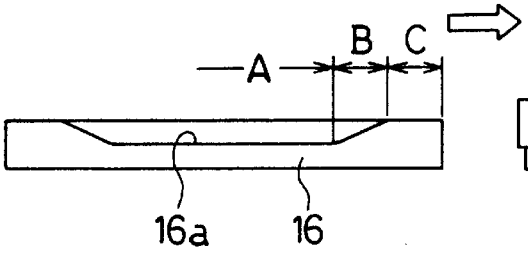
FIG. 9A is a cross-sectional view of an abrading plate used in polishing.
Figure 9B:
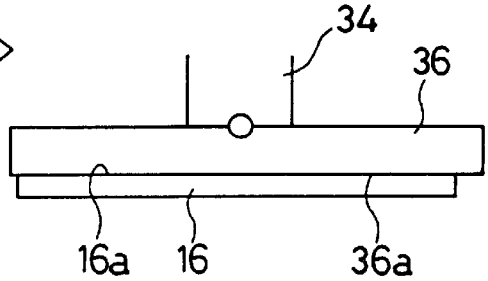
FIG. 9B is a cross-sectional view showing the abrading plate after dressing.

After polishing is conducted for a certain period of time, the thickness of the abrading plate 16 is reduced as shown in FIG. 9A. The central region A of the polishing surface 16*a* has a large wear (abrasion), the outer peripheral region C of the polishing surface 16*a* has a small wear, and the intermediate region B of the polishing surface 16*a* has an inclined surface which has been obliquely worn away. In this case, the swing arm of the dressing apparatus 14 is swung so that the central axis of the dresser shaft 34 is substantially aligned with the central axis $O_1$ of the drive shaft 20 of the polishing table 10. Then, the dresser 36 is lowered and pressed against the polishing surface 16*a* of the polishing table 10 which makes a circulative translational motion along a circle having a radius "e" without rotating on its own axis by energizing the motor 18. At the same time, the dresser 36 is rotated by the motor 38. Thus, the polishing surface 16*a* of the polishing table 10 is dressed by the dressing surface 36*a* of the dresser 36 for thereby planarizing the polishing surface 16*a*, as shown in FIG. 9B.

At this time, since the polishing surface 16*a* of the abrading plate 16 is covered in its entirety by the flat dressing surface 36*a*, local contacts between the polishing surface 16*a* and the dressing surface 36*a* are prevented to thus avoid dressing irregularities. Therefore, the polishing surface 16*a* is uniformly regenerated and planarized over the entire surface.

Current of the motor 38 for rotating the dresser 36 is detected by the motor current detector 44*b*, and a signal generated in the motor current detector 44*b* is sent to the signal processing device 46. In the signal processing device 46, noise is removed from the signal and a predetermined signal processing is carried out to determine an end point of dressing when the polishing surface 16*a* is planarized. When the signal processing device 46 determines the end point of dressing, it sends an end point signal to the controller 48 which in turn stops the dressing operation of the dresser 36.

The end point of dressing is detected in the following manner:

The frictional force between the dressing surface 36*a* of the dresser 36 and the polishing surface 16*a* of the polishing table 10 during dressing acts on the polishing table 10 as a resistance torque. In the case where the polishing table 10 is rotated by an electric motor, the change of torque is measured indirectly as change of current in the electric motor. Therefore, by measuring current value, the change of dressing state of the polishing surface during dressing is detected.

Figure 10:
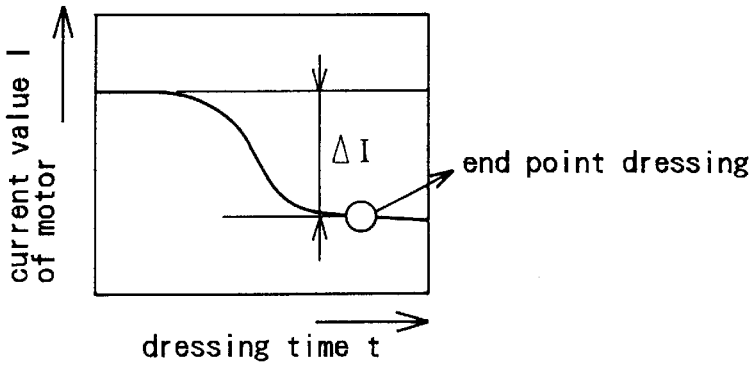
FIG. 10 is a graph showing change of current value in a motor during dressing.

FIG. 10 illustrates test results in the actual apparatus by the inventors of the present application, and a graph showing current of the motor 38, for rotating the dresser 36, detected by the motor current detector 44*b*. In FIG. 10, the horizontal axis represents a dressing time t, and the vertical axis represents current value I of the motor. FIG. 10 shows that the load is large at the beginning of dressing, gradually decreases, and becomes constant in time. This means that as dressing progresses, irregularities of the polishing surface 16*a* is being removed to lower coefficient of friction between the dresser 36 and the polishing surface 16*a*. Therefore, a suitable factor should be utilized to detect the end point of dressing shown by ○ in FIG. 10. This factor includes a gradient in curve showing current value, the current difference ΔI between current at the beginning of dressing and current at the present time of dressing, and current value in itself.

Figure 11A:
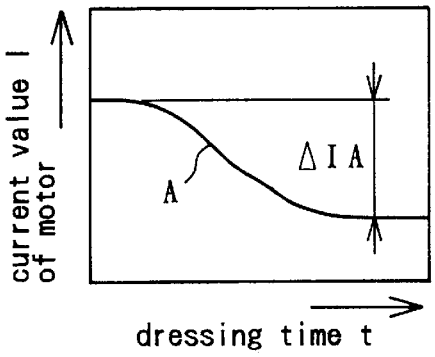
FIG. 11A and 11B are graphs showing change of current value in a motor when dressing is performed by dressers having a different wear.
Figure 11B:
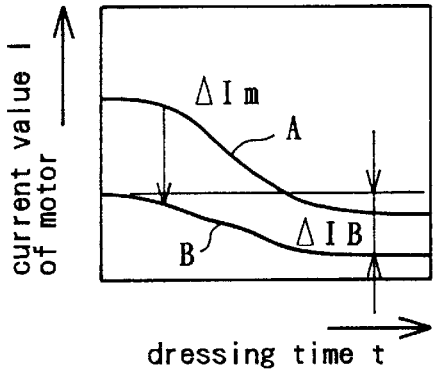

Further, the judgement device may be used for judging a life of the dresser, i.e., replacement time of the dresser. FIGS. 11A and 11B show the change of current of a motor when dressing is performed by dressers having different degree of wear. In FIGS. 11A and 11B, the curve A shows the change of electric current of a motor when dressing is performed by a dresser having no wear, and the curve B shows the change of electric current of a motor when dressing is performed by a dresser having developed wear. When comparing the curve A and the curve B, the load in the curve B is smaller than that in the curve A, and the current difference ΔI (the difference between motor current I at the beginning of dressing and motor current I at the termination of dressing) in the curve B ($\Delta I_B$) is smaller than that in the curve A ($\Delta I_A$). Therefore, the life of the dresser, i.e., the replacement time of the dresser is determined when the current difference $\Delta I$ is equal to a predetermined reference value. Alternatively, as shown in FIG. 11B, the life of the dresser is determined when the current difference ($\Delta I_m$) between current values at the beginning of dressing reaches a predetermined value.

In this example, the end point of dressing is judged on the basis of current of the motor 38 for rotating the dresser 36, and the dressing operation is terminated. However, the dressing process may be controlled stepwise by changing setting of dressing condition such as pressing force applied to the polishing surface 16*a* by the dresser 36 or the rotational speed of the polishing table 10.

Figure 12A:
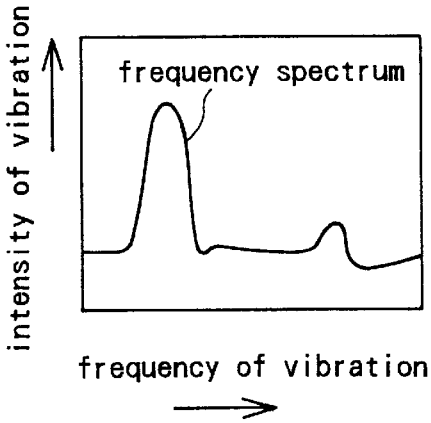
FIG. 12A is a graph showing frequency spectrum immediately after beginning of dressing.
Figure 12B:
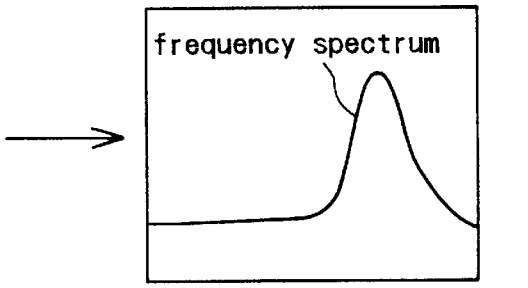
FIG. 12B is a graph showing frequency spectrum after dressing is completed.

In the above embodiment, although current value of the motor 38 for rotating the dresser 36 is utilized, current of the motor 18 for rotating the drive shaft 20 of the polishing table 10 may be utilized. In this case, as shown in FIG. 4, the signal of the motor current detector 44*a* connected to the motor 18 for rotating the polishing table 10 is processed by the signal processing device 46. Further, as the dressing progresses, vibration generated on the dressing surface or the polishing surface during dressing is changed. For example, FIG. 12A is a graph showing the change of frequency spectrum immediately after the dressing is started, and FIG. 12B is a graph showing the change of frequency spectrum after the polishing surface is planarized and dressing operation is terminated. In FIGS. 12A and 12B, the horizontal axis represents frequency of vibration, and the vertical axis represents intensity of vibration. A vibration detector is provided at a given position, and the change of vibration is detected and progress of dressing of the polishing surface is judged. For example, when the detected frequency spectrum becomes a certain wave form, it is judged that the dressing operation should be terminated. Further, a CCD camera is provided at a certain position, the polishing surface after polishing is imaged, and dressing condition is determined on the basis of the image obtained by the CCD camera. Further, the polishing surface which has been dressed may be confirmed by the CCD camera.

After the dressing operation is completed, the dresser 36 is returned to the standby position by rotation of the support shaft 40, and is lowered to be immersed in a cleaning liquid in a dresser cleaning container 52. The dresser 36 is automatically cleaned in the dresser cleaning container 52.

Figure 13A:
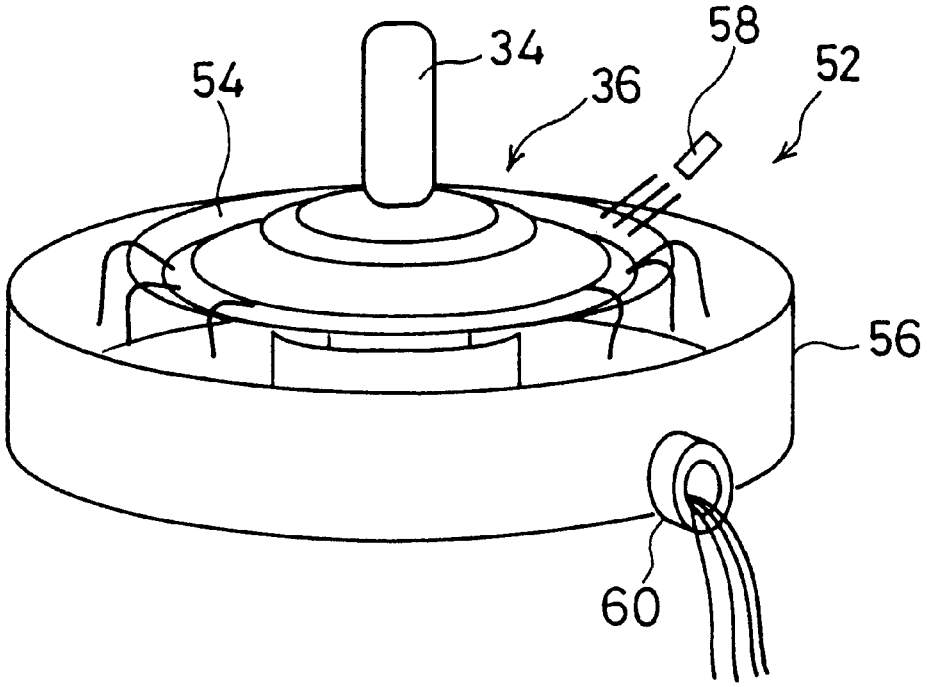
FIG. 13A is a perspective view of a dresser cleaning container according to one embodiment.
Figure 13B:
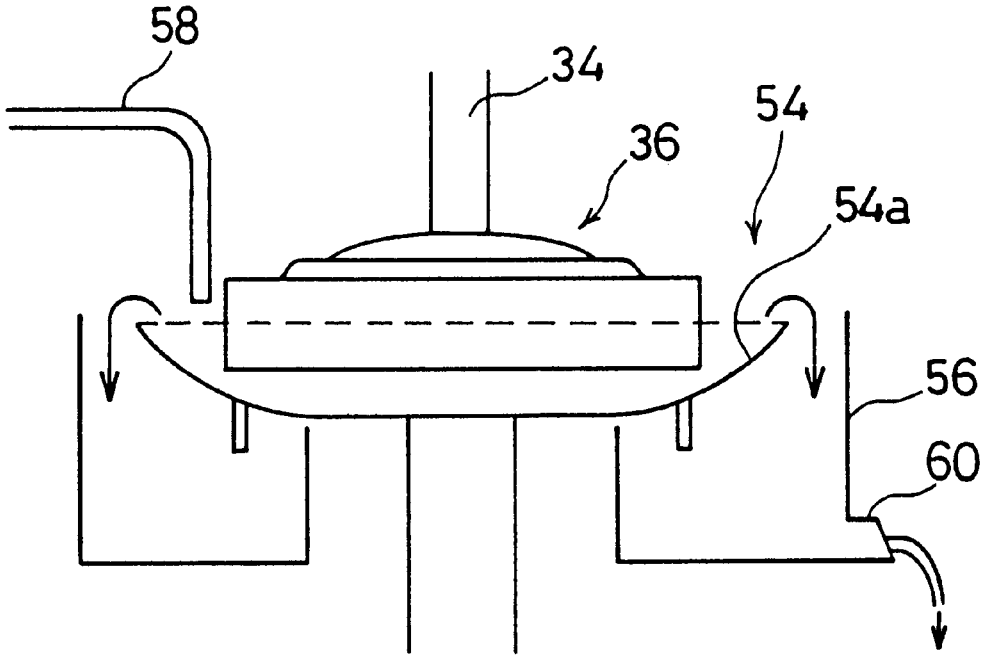
FIG. 13B is a cross-sectional view of the dresser cleaning container shown in FIG. 13A.

FIGS. 13A and 13B show an example of the automatic cleaning container. The dresser cleaning container 52 comprises a main cleaning container 54 having a relatively shallow depth, and a receiving container 56 for accommodating the main cleaning container 54 and receiving a cleaning liquid flowing out of the main cleaning container 54. The main cleaning container 54 has an inner diameter larger than the diameter of the dresser 36, and an outer peripheral portion which expands radially outwardly and upwardly to form an upwardly inclined surface so that the cleaning liquid flows smoothly from the inner lower part to the outer upper part. Further, the dresser cleaning container 52 has a cleaning liquid supply nozzle 58 for supplying a cleaning liquid such as pure water to the outer peripheral portion of the main cleaning container 54, and a drain hole 60 for discharging the cleaning liquid from the receiving container 56. The main cleaning container 54 has a depth of 12 mm and a volume of 600 $cm^3$, for example. The outer peripheral portion 54*a* of the main cleaning container 54 is inclined at an angle of 50° to horizontal. Instead of the cleaning liquid supply nozzle 58, a cleaning liquid supply port may be provided at the bottom of the main cleaning container 54.

In this automatic cleaning container, the main cleaning container 54 is filled beforehand with a cleaning liquid, and the dresser 36 is lowered at a certain speed or more and the dressing surface 36*a* of the dresser 36 is immersed in the cleaning liquid in the main cleaning container 54 as shown in FIGS. 13A and 13B. Thus, the cleaning liquid is discharged from the main cleaning container 54 by the amount corresponding to the volume of the dresser 36 immersed in the cleaning liquid to thus form a large flow of the cleaning liquid, and therefore the dressing surface 36*a* is efficiently cleaned. Further, by supplying a cleaning liquid from the cleaning liquid supply nozzle 58, the dressing surface 36*a* is continuously cleaned. During cleaning, the dresser 36 may be rotated or stationary. Dirty cleaning liquid overflows the main cleaning container 54, and is received by the receiving container 56 and then discharged from the drain hole 60 of the receiving container 56. In this manner, since the cleaning liquid in the main cleaning container 54 is always replaced with a fresh cleaning liquid, the cleaning liquid is prevented from being contaminated due to generation of bacteria, and accumulation of ground-off material is prevented.

As shown in FIGS. 13A and 13B, it is desirable that by adjusting lowering position of the dresser 36, the upper surface of the dresser 36 is prevented from being immersed in the cleaning liquid and from being contaminated. In this case, the ratio of the volume of the immersed part of the dresser 36 to the content volume of the main cleaning container 54 is 1:1.5 to 2.5, preferably 1:1.5 to 2.0. It is desirable that the cleaning liquid is continuously supplied to the main cleaning container 54 to replace the cleaning liquid in the main cleaning container 54 and to prevent the cleaning liquid from being contaminated, even if the dresser 36 is not located at the standby position. In this case, the cleaning liquid is supplied at the same flow rate as cleaning or at the reduced flow rate.

Figure 14:
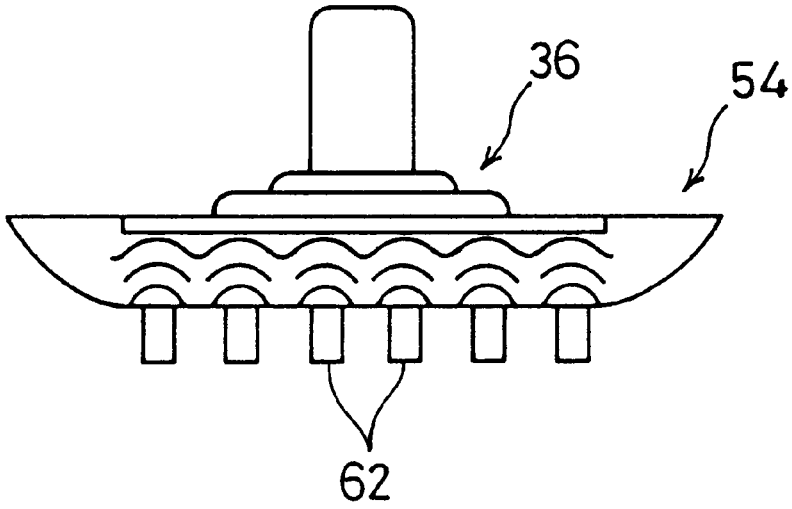
FIG. 14 is a cross-sectional view of a dresser cleaning container according to another embodiment.
Figure 15:
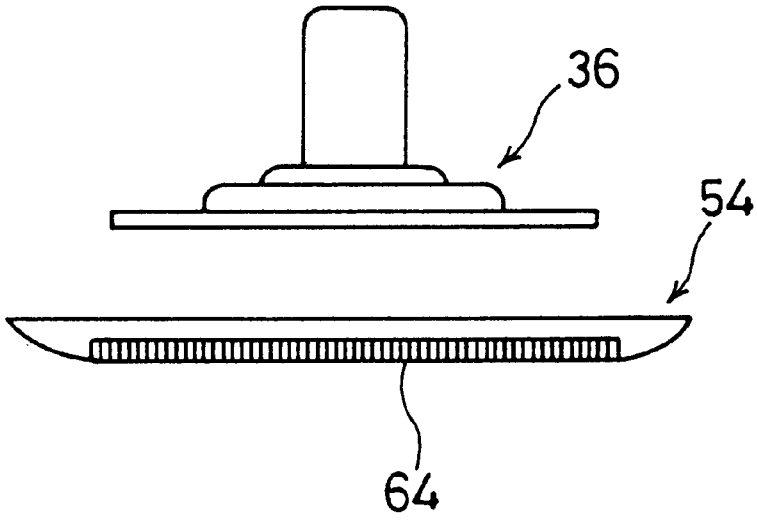
FIG. 15 is a cross-sectional view of a dresser cleaning container according to still another embodiment.

FIGS. 14 and 15 show an automatic cleaning container in other embodiments, and show only a main cleaning container 54, respectively. In the embodiment shown in FIG. 14, ultrasonic transducers 62 are attached to the bottom of the main cleaning container 54, and ultrasonic vibration is imparted to the main cleaning container 54 to heighten the cleaning effect in such a state that the dresser 36 is immersed in the cleaning liquid in the main cleaning container 54.

The condition of the ultrasonic vibration is as follows: the distance between the transducer (the bottom surface of the cleaning container) and the dressing surface 36*a* is in the range of 10 to 50 mm, the frequency of ultrasonic vibration generated by the transducer is about 28 kHz, the output of the transducer is in the range of 300 to 600 W, and the duration of the output of the transducer is in the range of 60 to 120 seconds. The ultrasonic vibration may be applied while the cleaning liquid is supplied or is not supplied. However, after application of the ultrasonic vibration is stopped, the cleaning liquid is supplied to the main cleaning container 54 to replace the cleaning liquid in the main cleaning container 54.

In the embodiment shown in FIG. 15, a brush 64 is attached to the inner surface of the bottom of the main cleaning container 54. In this embodiment, the dresser 36 is lowered to a certain height, and then rotated at a low speed whereby the dressing surface 36*a* is scrubbed by the brush 64 to clean the dressing surface 36*a* while the cleaning liquid is supplied. This cleaning process improves the cleaning effect of the dressing surface 36*a*. In the embodiment shown in FIG. 15 also, ultrasonic vibration may be applied in the same manner as the embodiment shown in FIG. 14.

One or more cavitation jet nozzles may be provided in the main cleaning container 54 or at certain locations around the main cleaning container 54. The cavitation jet nozzle comprises double nozzles for ejecting high-pressure water and low-pressure water to generate cavitation by the speed difference between the high-pressure water and the low-pressure water, thereby heightening the cleaning effect. In this case, the dresser 36 is not immersed in the cleaning liquid in the automatic cleaning container, but is located at a position where the dressing surface 36*a* is spaced from the automatic cleaning container by a certain distance. It is desirable that the distance between the forward end of the cavitation jet nozzle and the dressing surface 36*a* is in the range of 5 to 15 mm, the ejecting pressure of the cleaning liquid is in the range of 294 to 980 $N/cm^2$ (30 to 100 $kgf/cm^2$), and the flow rate of the cleaning liquid is in the range of 0.5 to 1.5 liter/sec. The top ring 28 may be cleaned by the cleaning container or the cavitation jet nozzle having the above structure.

Figure 16:
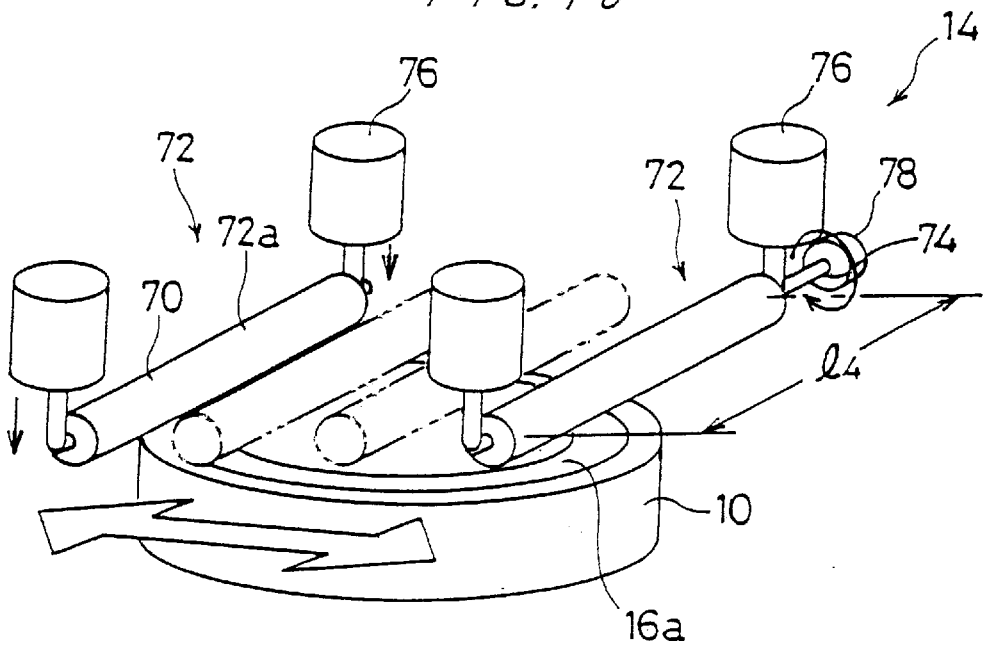
FIG. 16 is a perspective view of a dressing apparatus according to a second embodiment of the present invention.

FIG. 16 schematically shows a dressing apparatus 14 according to a second embodiment of the present invention. The dressing apparatus has dressers 72 comprising rollers 70 which rotate about respective shafts parallel to the polishing surface 16*a* of the polishing table 10, and dressing surfaces 72*a* provided around the rollers 70. The axial length $l_4$ of the roller 70 and the dressing surface 72*a* is set to be equal to or longer than an outer diameter of a circle defined by the scroll motion of the polishing table 10. That is, the length $l_4$ is set to the dimension obtained by adding two times eccentricity "e" to the diameter $d_1$ of the polishing surface 16*a*, i.e., $l_4 \geqq d_1+2e$.

The roller 70 is supported by a shaft 74 to which a fluid pressure cylinder 76 for vertically moving the roller 70 and pressing the roller 70 against the polishing surface 16*a*, a motor 78 for rotating the roller 70, and an actuator (not shown) for moving the roller 70 horizontally along the polishing surface 16*a* are connected. The above-mentioned components are supported by a dressing arm (not shown), and therefore the roller 70 may be swung between the polishing table 10 and the standby position. In this example, although the two rollers 70 are provided, one roller or three rollers may be provided.

In the case where dressing of the polishing surface 16*a* is conducted by the dressing apparatus 14 having the above structure, the dressing apparatus 14 is moved from the standby position to a position above the polishing table 10. Then, the roller 70 is lowered by the fluid pressure cylinder 76, and while the dressing surface 72*a* is pressed against the polishing surface 16*a* of the polishing table 10 under a certain pressure, the roller 70 is moved along the polishing surface 16*a* in a direction perpendicular to the shaft 74, thereby performing dressing of the polishing surface 16*a*. In this example, even if the polishing surface 16*a* has irregularities, the dressing surface 72*a* is brought in contact with the entire area of the polishing surface, and the polishing surface 16*a* is planarized. Thus, dressing of the polishing surface is efficiently conducted.

Figure 17:
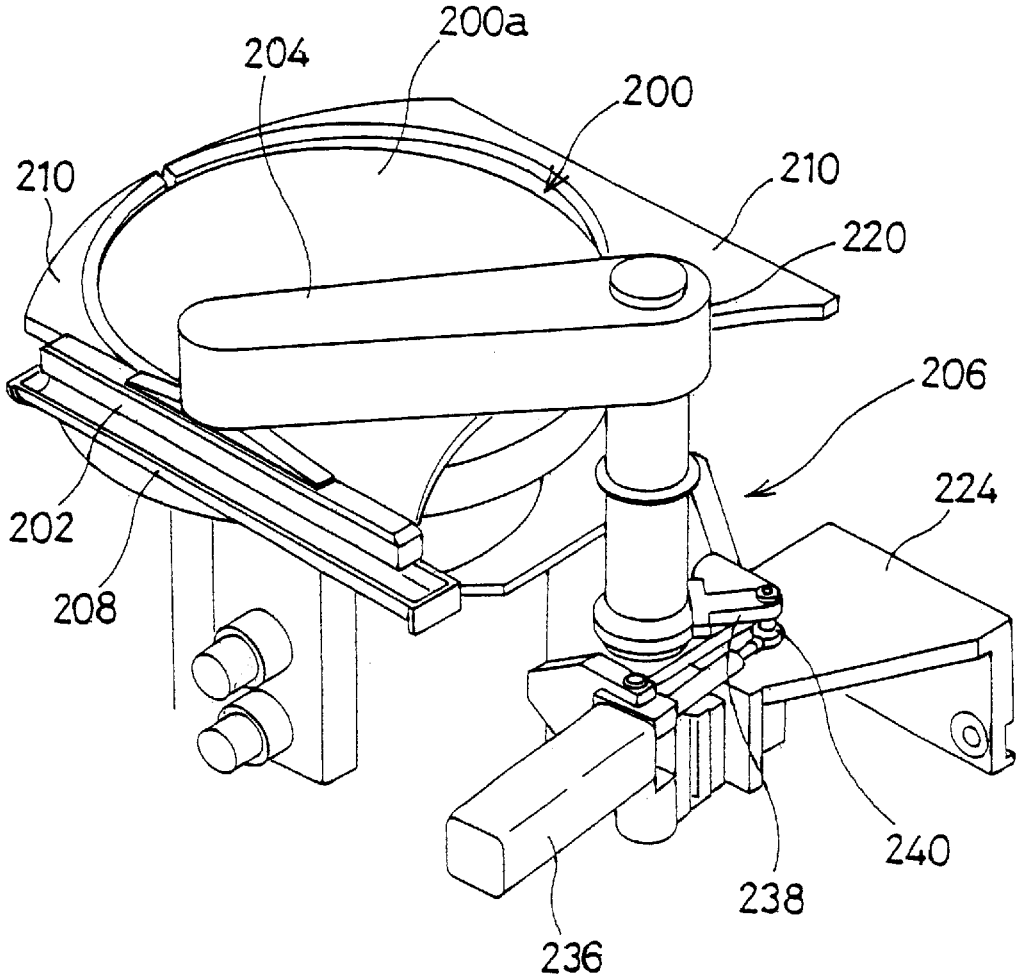
FIG. 17 is a perspective view of a dressing apparatus according to a third embodiment of the present invention.

FIGS. 17 through 23 show a dressing apparatus 14 according to a third embodiment of the present invention. As shown in FIG. 17, the dressing apparatus 14 comprises adresser 202 for dressing a polishing surface 200*a* of the polishing table 200, a dresser arm 204 having a free end for supporting the dresser 202 thereon, and a dresser driving mechanism 206 for swinging the dresser arm 204 and vertically moving the dresser arm 204. The dressing apparatus 14 further comprises a dresser cleaning container 208 for cleaning the dresser 202 by a cleaning liquid stored in the dresser cleaning container 208, and a pair of guide tables 210 provided at both sides of the polishing table 200 for preventing the dresser 202 from falling out of the polishing table 200.

Figure 18:
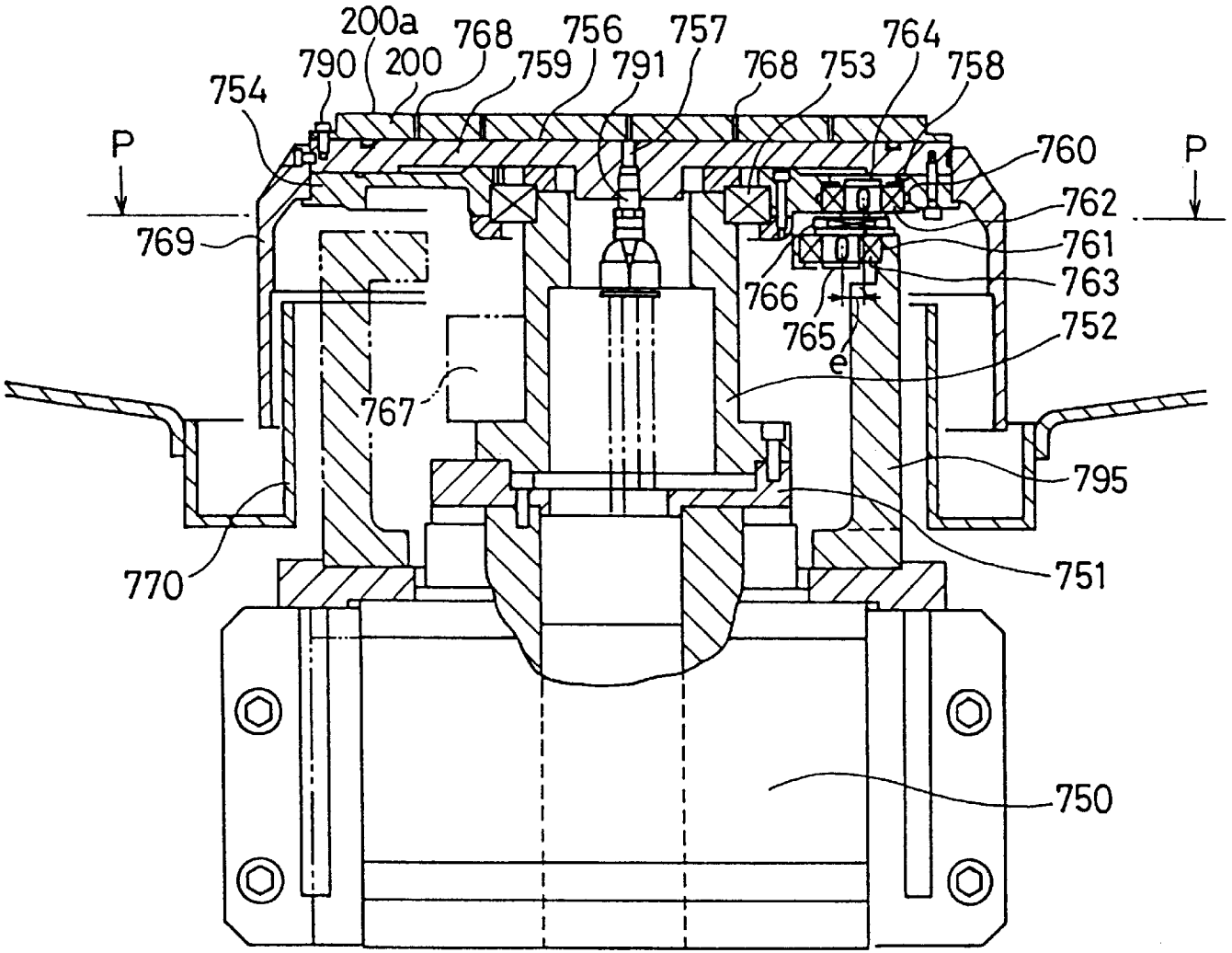
FIG. 18 is a vertical cross-sectional view of a polishing table used in the embodiment shown in FIG. 17.
Figure 19A:
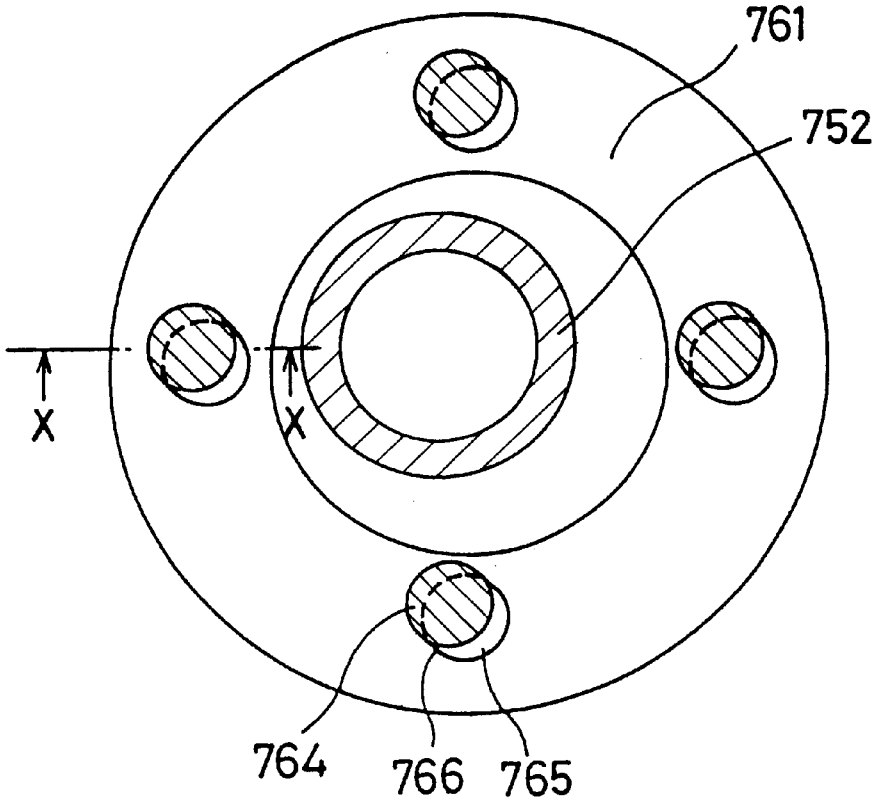
FIG. 19A is a cross-sectional view taken along line P—P of FIG. 18.
Figure 19B:
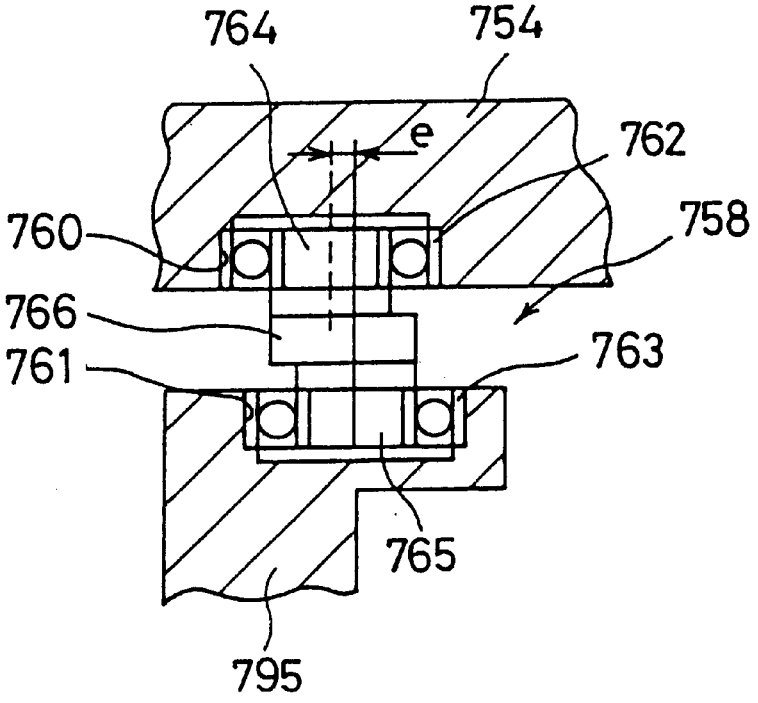
FIG. 19B is a cross-sectional view taken along line X—X of FIG. 19A.

FIGS. 18, 19A and 19B show a polishing table 200. As shown in FIGS. 18, 19A and 19B, the scroll-type polish table 200 has an upper flange 751 of a motor 750, and a hollow shaft 752 connected to the upper flange 751 by bolts. A set ring 754 is supported by the upper portion of the shaft 752 through a bearing 753. A table 759 is fixed to the set ring 754, and a polishing table 200 is fixed to the table 759 by bolts 790. The polishing table 200 may comprise an abrading plate (fixed abrasive plate) entirely, or may comprise a plate made of a corrosion-resistant metal such as stainless steel and a polishing cloth attached to the plate. In case of using the abrading plate or the polishing cloth, the polishing table 200 may have a flat upper surface or a slightly convex or concave upper surface. The shape of the upper surface of the polishing table 200 is selected depending on the kind of the semiconductor wafer (substrate) W to be polished. The outer diameter of the polishing table 200 is set to be equal to or larger than the dimension obtained by adding the distance 2e to the diameter of the substrate W. That is, the diameter of the polishing table 200 is arranged such a dimension that when the polishing table 200 makes a circulative translational motion, the substrate W does not project from the outer periphery of the polishing table 200. The translational motion may be called scroll motion or orbital motion.

The set ring 754 has three or more supporting portions 758 in a circumferential direction, and the table 759 is supported by the supporting portions 758. A plurality of recesses 760, 761 are formed at positions corresponding to the upper surface of the supporting portions 758 and the upper end of the cylindrical member 795 at angularly equal intervals in a circumferential direction, and bearings 762 and 763 are mounted in the recesses 760 and 761. As shown in FIGS. 18, 19A and 19B, a support member 766 having two shafts 764 and 765 whose central axes are spaced by "e" is supported by the bearings 762 and 763. Specifically, the two shafts 764 and 765 are inserted into the bearings 762 and 763, respectively. Thus, the polishing table 200 makes a translational motion along a circle having a radius "e" by the motor 750.

Further, the center of the shaft 752 is off-centered by "ee" from the center of the flange 751 and the center of the motor 750. A balancer 767 is fixed to the shaft 752 for providing a balance to the load caused by eccentricity. The supply of the polishing liquid onto the polishing table 200 is conducted through the insides of the motor 750 and the shaft 752, a through-hole 757 provided at the central portion of the table 759, and a coupling 791. The supplied polishing liquid is once stored in a space 756 defined between the polishing table 200 and the table 759, and then supplied to the upper surface of the polishing table 200 through a plurality of through-holes 768 formed in the polishing table 200. The number and position of the through-holes 768 can be selected depending on the kind of processes. In the case where the polishing cloth is attached to the polishing table 200, the polishing cloth has through-holes at positions corresponding to the positions of the through-holes 768. In the case where the polishing table 200 is made of an abrading plate in its entirety, the upper surface of the polishing table 200 has grid-like, spiral, or radial grooves, and the through-holes 768 may communicate with such grooves.

The supplied polishing liquid may be selected from pure water, chemicals, or slurry, and, if necessary, more than one kind of the polishing liquid can be supplied simultaneously, alternatively, or sequentially. In order to protect a mechanism for performing a translational motion from the polishing liquid during polishing, a flinger or a thrower 769 is attached to the table 200, and forms a labyrinth mechanism together with a trough 770.

In the polishing table having the above structure, the upper and lower bearings 762, 763 are axially interconnected by the support member 766 comprising a cranked joint having the upper and lower shafts 764, 765 that are fitted respectively in the upper and lower bearings 762, 763. The shafts 764, 765 and hence the upper and lower bearings 762, 763 have respective axes horizontally spaced from each other by a distance "e". The cylindrical member 795 for supporting the lower bearing 763 is fixed to the frame, and hence is stationary. When the motor 750 is energized, the shaft 752 is rotated by the radius of gyration (e) about the central axis of the motor 750, and thus the polishing table 200 makes a circulative translational motion (scroll motion) through the cranked joint, and the substrate W attached to the top ring is pressed against a polishing surface of the polishing table 200. The substrate is polished by the polishing liquid supplied through the through-hole 757, the space 756 and the through-holes 768. The substrate is polished by the relative circulative translational motion having a radius "e" between the polishing surface of the polishing table 200 and the substrate, and the substrate is uniformly polished over the entire surface thereof. If a surface, to be polished, of the substrate and the polishing surface have the same positional relationship, then the polished substrate is influenced by a local difference in the polishing surface. In order to eliminate this influence, the top ring is rotated at a low speed to prevent the substrate from being polished at the same area on the polishing surface.

Figure 20:
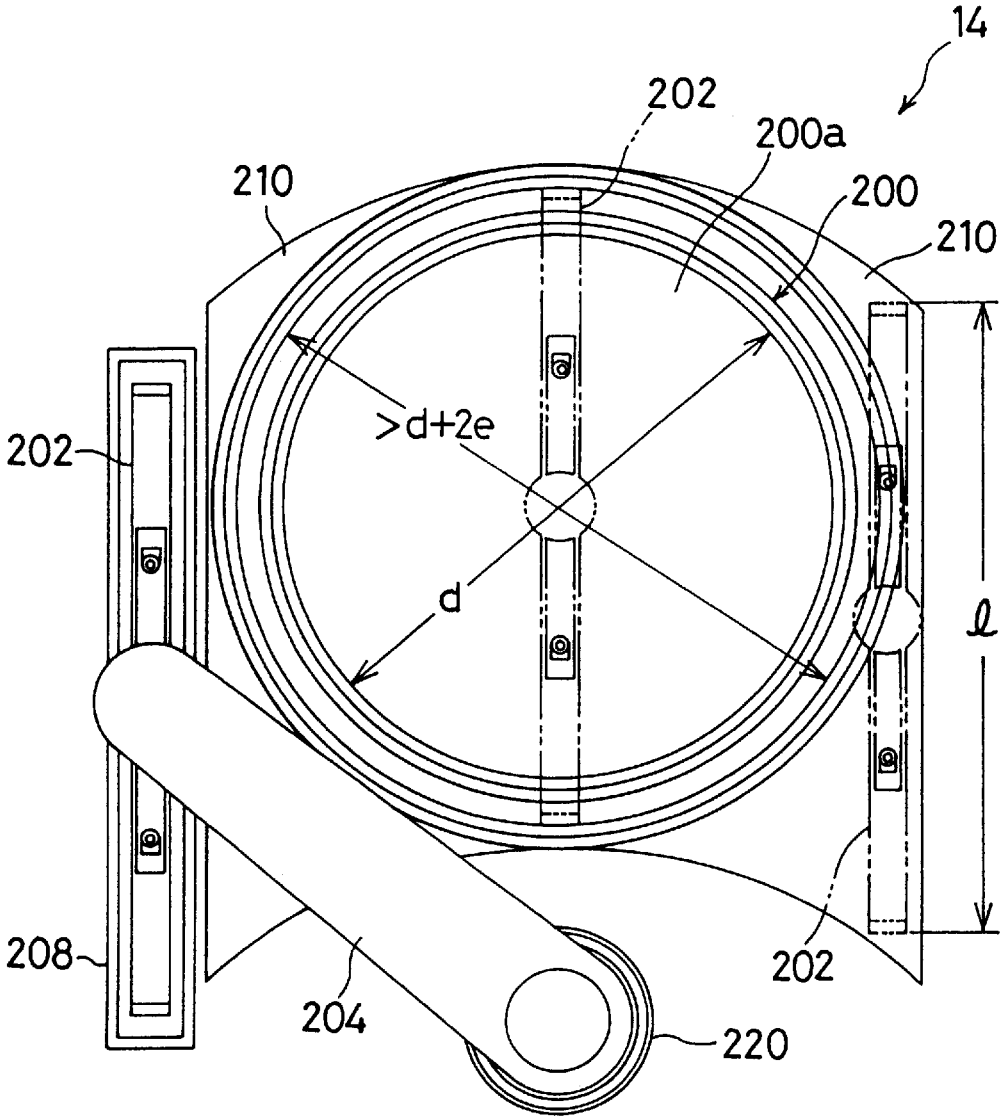
FIG. 20 is a plan view of the dressing apparatus shown in FIG. 17.

As shown in FIG. 20, the dresser 202 has an elongate shape, and the length l of the dresser 202 is set to be larger than the dimension (corresponding to movement area of the polishing surface) obtained by adding two times eccentricity "e" to the diameter d of the polishing surface 200*a*, i.e., $l>d+2e$. The width of the dresser 202 is set to the dimension as small as possible if the dresser condition permits. That is, when comparing the length l with the diameter $d_2$ of the semiconductor wafer, $l>d_2+4e$. This structure of the dresser 202 allows the space in a width direction to be saved greatly, compared with a circular dresser. Similarly, the dresser cleaning container 208 may be rectangular so as to correspond to the shape of the dresser 202, thus saving an installation space of the dresser cleaning container 208. Further, the polishing table does not rotate about its own axis but makes a scroll motion, and therefore the dresser has such a structure that the dresser does not rotate about its own axis. The relative velocity between the polishing table and the dresser becomes equal on every point on the polishing surface by the scroll motion of the polishing table and horizontal movement of the dresser at a constant velocity.

In the dressing apparatus 14 according to this embodiment, the dresser 202 is vertically movable by an air cylinder, and the pressing amount is controlled by a stroke type mechanism using an air cylinder and a stopper. The dresser 202 is horizontally moved by a swing motion and a motion of a link mechanism. The dresser 202 has a lower surface to which a dresser element (cleaning member) 212 made of soft elastic material is attached, and the lower surface of the dresser element 212 constitutes a dressing surface 212*a*.

As shown in FIGS. 20 through 23, the dressing apparatus 14 comprises a vertical shaft 218 which moves vertically and is guided by a guide 216 fixed to a base 214, a swing shaft 220 having a follow structure and enclosing the vertical shaft 218, and a dresser arm 204 coupled to the swing shaft 220. The dresser arm 204 has a free end which supports the dresser 202. On the other hand, a lifting/lowering cylinder 222 is fixed to the base 214, and has a piston rod whose upper end is coupled to a lifting/lowering base 224 fixed to the vertical shaft 218. The piston rod of the lifting/lowering cylinder 222 passes through the cylinder body and extends downwardly, and a stopper 226 is attached to the piston rod by a fixing member such as a screw so that the stopper 226 is positionally adjustable to the piston rod. Thus, when the lifting/lowering cylinder 222 is actuated, the vertical shaft 218, the swing shaft 220 and the dresser arm 204 are integrally lifted or lowered, and the stopper 226 attached to the piston rod of the lifting/lowering cylinder 222 contacts the lower end of the cylinder body of the lifting/lowering cylinder 222 to limit a lifting position of the dresser 202. By fixing the lifting position of the dresser 202, dressing is performed at a constant pressure at all times. Lifting of the dresser 202 is limited to a certain height by the stopper 226. The lifting height of the dresser 202 is set to the height at which the dresser element 212 of the dresser 202 can press the polishing surface 200*a* and the dressing surface 212*a* can dress the polishing surface 200*a* when the dresser 202 moves horizontally. Each of the guide tables 210 has an upper surface flush with the polishing surface 200*a*.

The vertical shaft 218 has an upper end to which a drive pulley 228 is mounted, and a belt 234 is provided between the drive pulley 228 and a driven pulley 232 mounted on a dresser support shaft 230 rotatably provided at the free end of the dresser arm 204. A bearing 231 is interposed between the vertical shaft 218 and the swing shaft 220. Further, the dresser support shaft 230 extends downwardly, and has a lower end to which the dresser 202 is attached.

On the other hand, a swing cylinder 236 is fixed to the lifting/lowering base 224, and a piston rod of the swing cylinder 236 is connected through a ball joint 240 to a forward end of a link arm 238 projecting in a direction perpendicular to an axis of the swing shaft 220. Thus, when the lifting/lowering cylinder 222 is actuated, the swing cylinder 236 is vertically moved integrally with the lifting/lowering base 224, and when the swing cylinder 236 is actuated, the swing shaft 220 is rotated to allow the dresser arm 204 to be swung. When the dresser arm 204 is swung, the dresser 202 moves horizontally to perform a translation at a constant speed in one direction by a translation mechanism comprising the pulleys 228, 232 and the belt 234.

Figure 22:
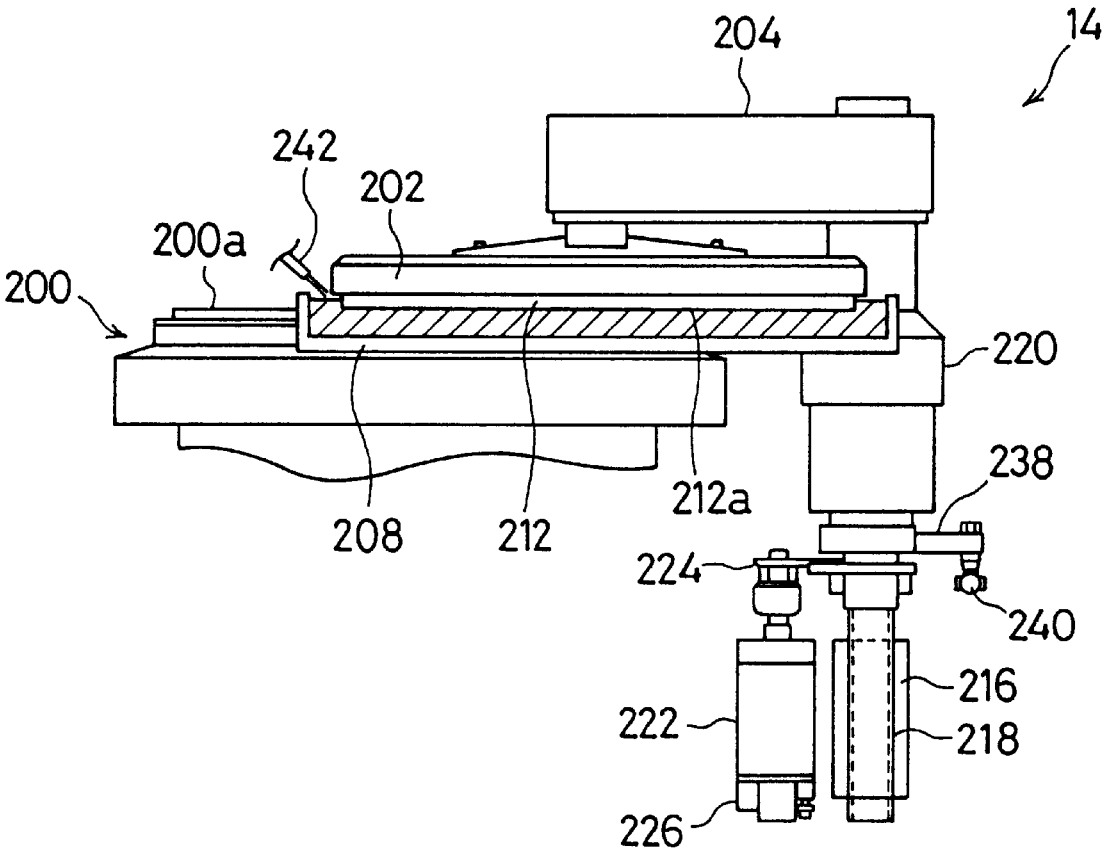
FIG. 22 is a left side view with a partially cross-sectioned part of the dressing apparatus shown in FIG. 20.

In this embodiment, the dresser cleaning container 208 serves to prevent the dresser element 212 from drying. As shown in FIG. 22, a tube 242 is attached to the dresser cleaning container 208 for supplying a cleaning liquid to the dresser cleaning container 208, and the cleaning liquid is always supplied to the dresser cleaning container 208 to keep the cleaning liquid in the dresser cleaning container 208 clean. The dresser 202 is located at a lowered position on the standby condition, and the dresser element 212 is immersed in the cleaning liquid in the dresser cleaning container 208 to prevent the dresser element 212 from drying.

Next, a series of operations in which the dresser 202 is removed from the dresser cleaning container 208, and dresses the polishing surface 200*a* of the polishing table 200, and then returned to the dresser cleaning container 208 will be described.

The dresser 202 is located at a lowered position in the dresser cleaning container 208. By actuating the lifting/lowering cylinder 222, the dresser 202 is lifted and removed from the dresser cleaning container 208. The lifting position of the dresser 202 is determined by the stopper 226. In this state, the swing cylinder 236 is actuated, and the swing shaft 220 is rotated to swing the dresser arm 204 toward the polishing surface 200*a* of the polishing table 200. Then, since the drive pulley 228, the driven pulley 232 and the belt 234 jointly constitute a link mechanism for performing a translation of the dresser 202, even if the dresser arm 204 is swung by rotation of the swing shaft 220, the dresser 202 does not change its direction but performs a translation. Therefore, the dresser 202 is transferred onto the polishing surface 200*a* of the polishing table 200, and then the dresser element 212 is pressed against the polishing surface 200*a* to dress the polishing surface 200*a* by the dressing surface 212*a*. The center of the dresser 202 passes through the center of the polishing surface 200*a*, and the length 1 of the dresser 202 is larger than the diameter of the circle which is described by the outer periphery of the polishing surface 200*a* which makes a scroll motion. Thus, the dresser 202 can dress the entire area of the polishing surface 200*a*.

Figure 21:
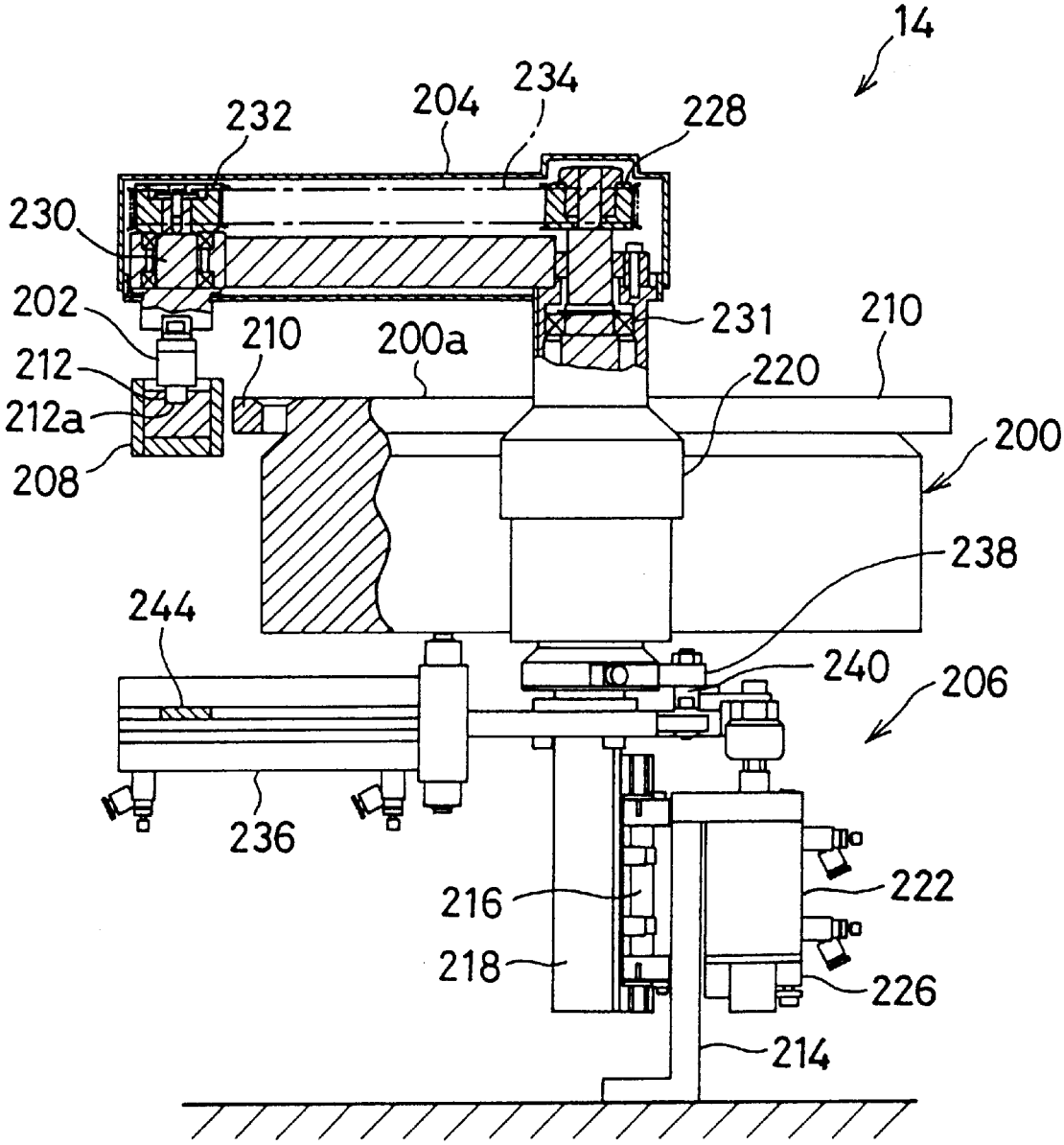
FIG. 21 is a front view with a partially cross-sectioned part of the dressing apparatus shown in FIG. 20.

The dresser 202 moves along the polishing surface 200*a* while dressing the polishing surface 200*a* which makes a scroll motion, and reaches an end of the polishing surface 200 at its stroke end and stops. Thereafter, the dresser 202 moves in an opposite direction by switching the operational direction of the link mechanism while dressing the polishing surface 200*a*. As shown in FIG. 21, a sensor 244 for detecting the stroke end of the swing cylinder 236 is attached to the swing cylinder 236 to determine timing of switching the direction of the link mechanism and monitor the operation.

The guide tables 210 are provided to surround the polishing table 200, and have such a shape that the guide tables 210 are disposed along the outer periphery of the scroll motion of the polishing table 200 and along swing range of the dresser 202. That is, each of the guide tables 210 has an inner circular periphery whose radius is equal to or larger than (d+2e)/2 from a center of the scroll motion of the polishing table 200. Further, each of the guide tables 210 has an upper surface flush with the polishing surface 200*a*, and when the dresser 202 projects from the polishing table 200, the dresser element 212 is prevented from projecting downwardly by a length corresponding to elasticity. Thus, when the dresser 202 is transferred to the polishing table 200, if the step between the lower end of the dresser 202 and the upper end of the polishing table 200 cannot be absorbed by the polishing table 200 and the dresser element 212, then in case of the polishing table 200 having a polishing cloth attached thereto, the polishing cloth may be removed. In the worst case, the dresser 202 may collide with the side surface of the polishing table 200 to be damaged. However, since the guide tables 210 are provided around the polishing table 200, the dresser 202 can be smoothly transferred to the polishing table 200.

The dressing is repeated by the predetermined number of times, and then the dresser is returned to the dresser cleaning container 208 and dressing operation is terminated.

Figure 23:
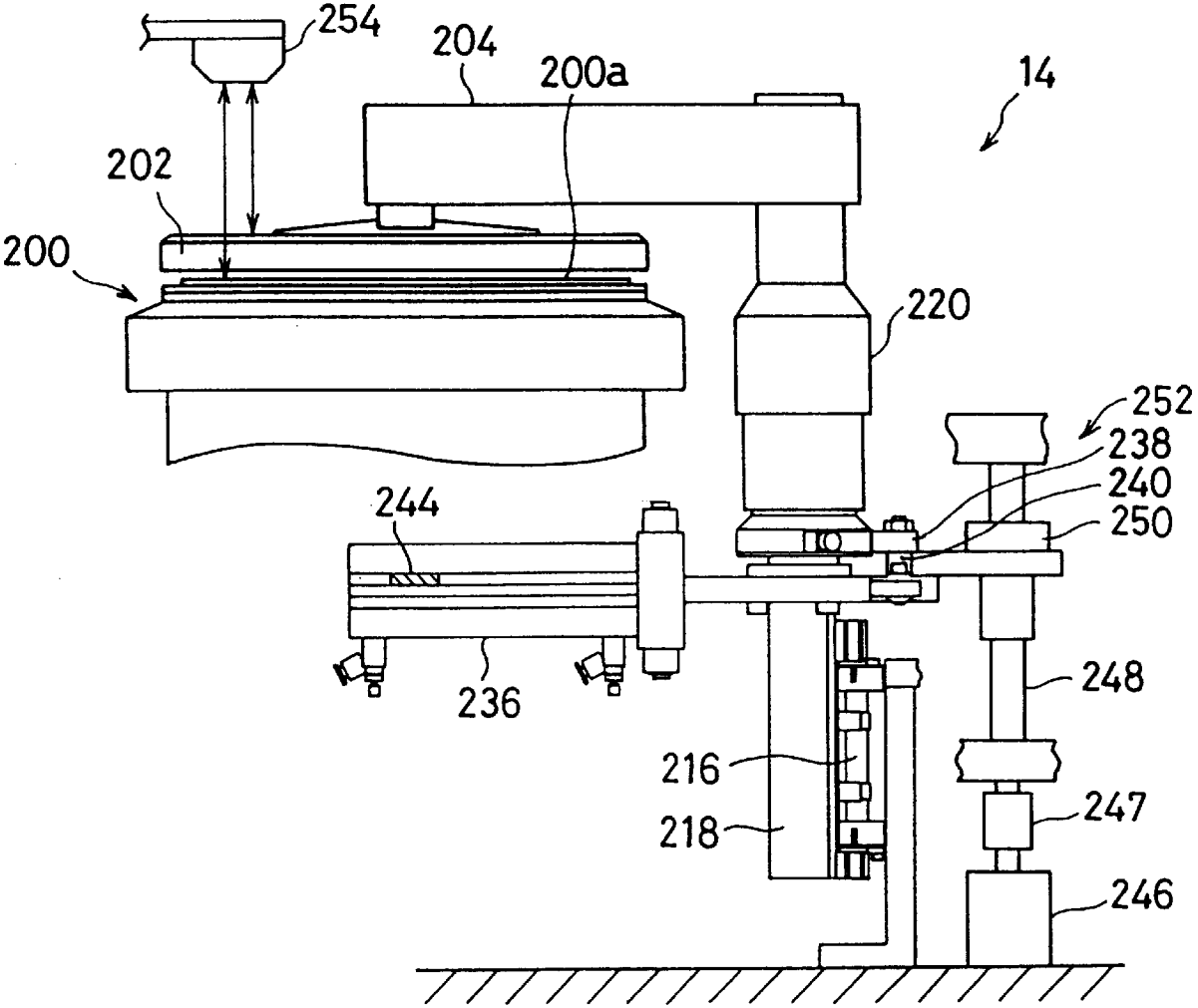
FIG. 23 is a side view showing the state in which the dresser is positioned above the polishing table.

In this embodiment, pressing of the dresser element 212 against the polishing surface 200*a* is controlled by a control method for controlling a pressing amount. In order to keep the height of the dresser 202 constant, the stopper 226 is attached to the lifting/lowering cylinder 222. The thickness of the polishing table 200 having the polishing surface 200*a* is reduced every time the dressing is performed. In order to follow this thickness variation of the polishing table 200, as shown in FIG. 23, there are provided a stepping motor 246, a lifting/lowering mechanism 252 comprising a screw 248 which is coupled to the stepping motor 246 through a coupling 247 and rotated by the stepping motor 246, and a nut 250, fixed to the lifting/lowering base 224, into which the screw 248 is threaded, and a noncontact-type distance measuring sensor 254 disposed above the polishing surface 200*a*. Thus, the height of the polishing surface 200*a* and the height of the dresser 202 are measured by the distance measuring sensor 254, and the pressing amount of the dresser 202 is determined by the height difference between two heights at the present time. The pressing amount at the present time is compared with a predetermined pressing amount to obtain a pressing amount difference. The pressing amount difference is converted into the number of pulses in the stepping motor 246, and the position of the dresser 202 is corrected by operating the stepping motor 246 by the number of pulses corresponding to the pressing amount difference. Every time the dressing is performed, this operation is carried out to keep the pressing amount constant. Therefore, the reliability of dressing can be improved.

Figure 24:
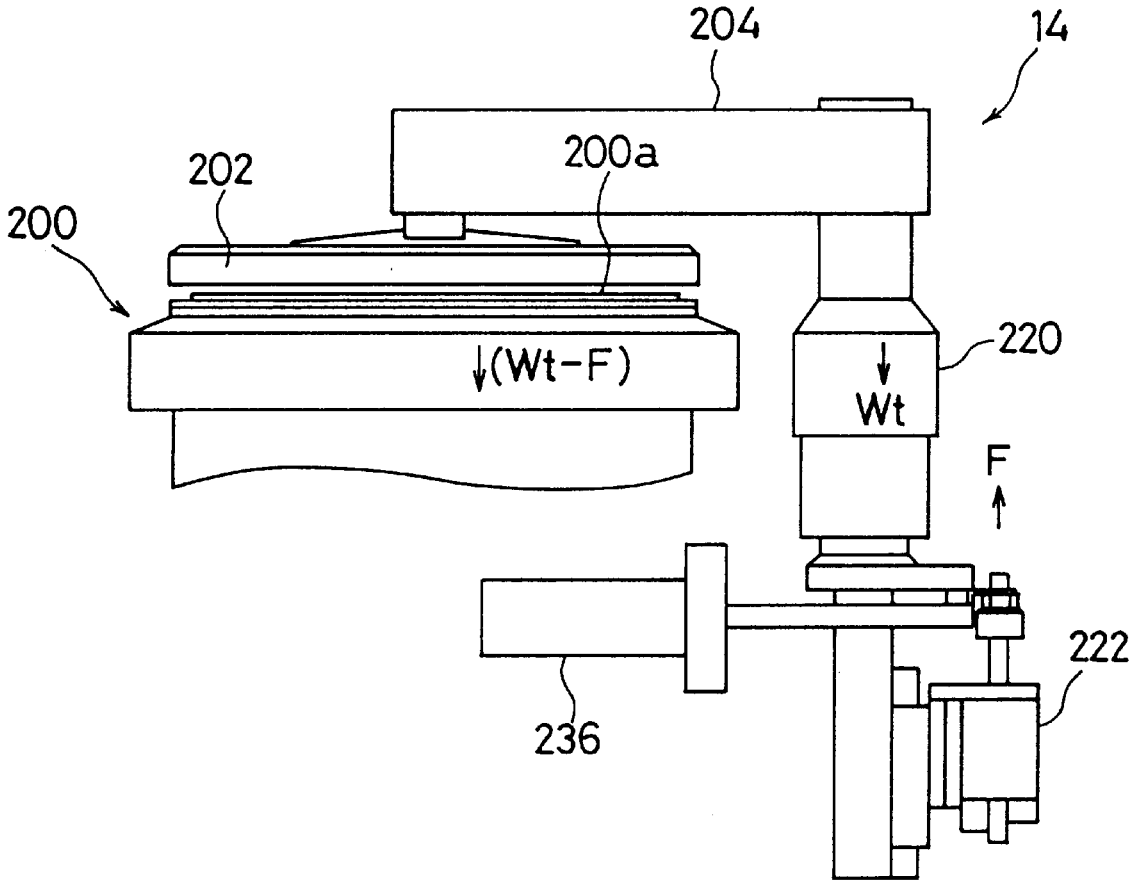
FIG. 24 is a side view of a dressing apparatus according to a fourth embodiment of the present invention.

FIG. 24 shows a dressing apparatus 14 according to a fourth embodiment of the present invention. The dressing apparatus 14 uses a control method for controlling a pressing force of the dresser element 212 against the polishing surface 200*a*. That is, the lifting/lowering cylinder 222 is used as a lifting/lowering mechanism of the dresser 202, and air pressure supplied to the cylinder 222 is controlled by an electropneumatic regulator or the like so that the difference (Wt−F) between the thrust force F of the lifting/lowering cylinder 222 and the weight Wt of the mechanism is equal to a target pressing force of the dresser 202 against the polishing surface 200*a*.

Figure 25:
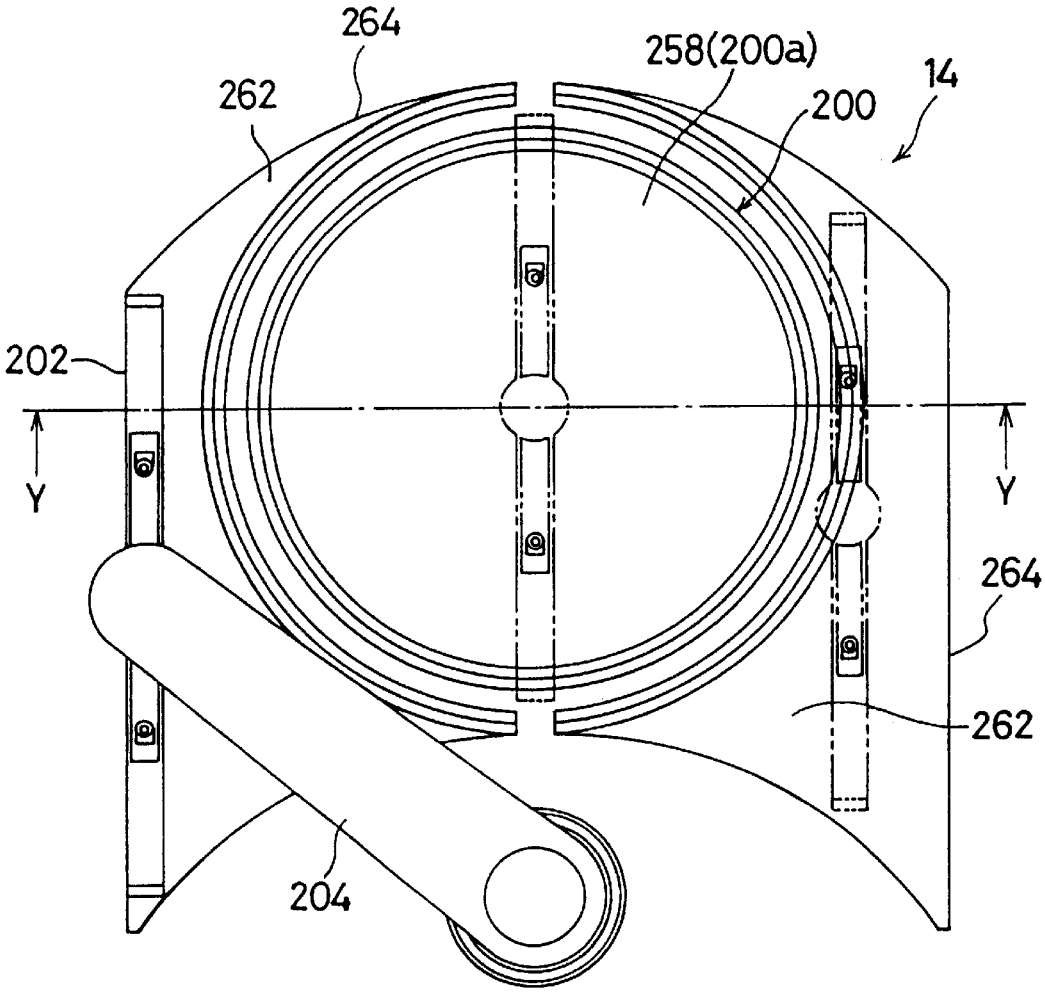
FIG. 25 is a plan view of a dressing apparatus according to a fifth embodiment of the present invention.
Figure 26:
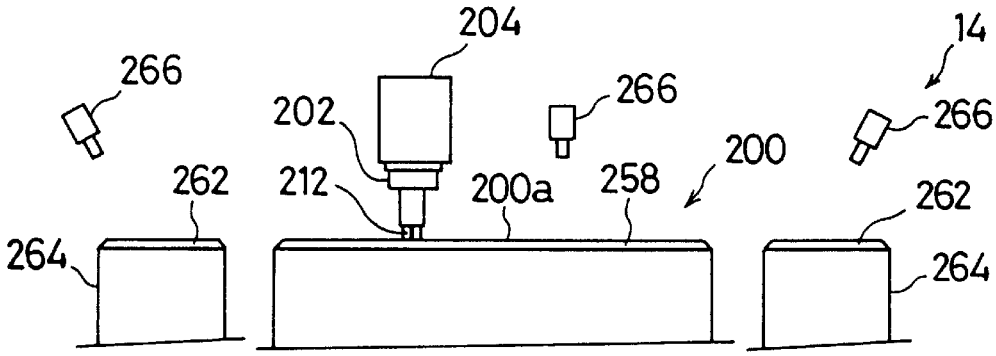
FIG. 26 is a cross-sectional view taken along line Y—Y of FIG. 25.
Figure 27:
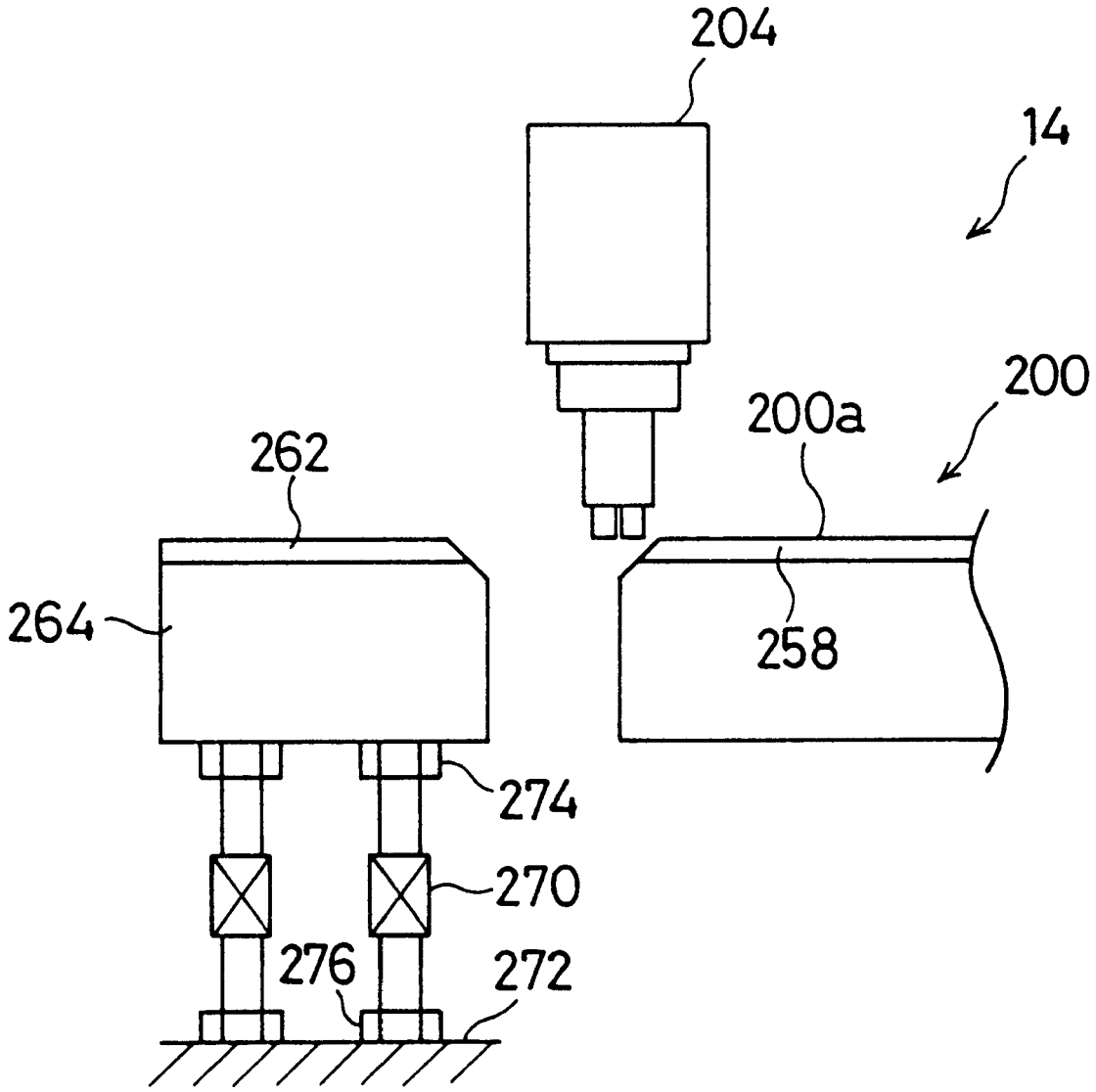
FIG. 27 is a front view of a height adjusting mechanism of a guide table in one embodiment.

FIGS. 25 through 27 show a dressing apparatus 14 according to a fifth embodiment of the present invention. In this embodiment, the dressing apparatus 14 uses a control method for controlling a pressing force of the dresser 202 as in the forth embodiment. Beside the polishing table 200 having an upper surface to which a polishing cloth 258 is attached, there are provided guide tables 264 each having an upper surface to which a polishing cloth 262 is attached so as to surround the polishing table 200. The polishing cloth 258 and the polishing cloth 262 are composed of the same kind of polishing cloth. If an abrading plate (fixed abrasive plate) is attached to he polishing table, the same abrading plates are attached to the guide tables 264.

Thus, when the dresser 202 is disengaged from the polishing table 200, the dresser 202 is prevented from falling out of the polishing table 200 by the amount corresponding to a remaining stroke in the pressing mechanism. Further, the area in which the dresser element 212 contacts the polishing surface 200*a* of the polishing table 200 is changed while the dresser is horizontally moving, to dress the polishing surface, and hence the dressing pressure applied to the polishing surface 200*a* by the dresser is changed. However, since the guide tables 264 are provided so as to surround the polishing surface 200*a*, the dressing pressure applied to the polishing surface 200*a* is constant, and uniform dressing can be performed.

Specifically, when the dresser 202 is transferred to the polishing table 200, if the step between the lower end of the dresser 202 and the upper end of the polishing table 200 cannot be absorbed by the polishing table 200 and the dresser element 212, then the polishing cloth may be removed. In the worst case, the dresser 202 may collide with the side surface of the polishing table 200 to be damaged.

Further, if control of pressure of the dresser against the polishing surface is performed by a pressing force, the area in which the dresser element 212 contacts the polishing surface 200*a* of the polishing table 200 is changed while the dresser is moving, and the dressing pressure is changed to impede uniform dressing. Therefore, in the dressing apparatus 14 according to this embodiment, beside the polishing table 200 having the polishing cloth 258 thereon, there are provided the guide tables 264 having the respective polishing cloths 262, which are the same kind as the polishing cloth 258, so as to surround the polishing table 200, and the polishing cloth 258 and the polishing cloths 262 are arranged so as to have the same height, thus solving the above problems.

In this embodiment, the dresser 202 can dress the entire area of the polishing surface 200*a* on the polishing cloth 258 without moving the dresser 202 vertically. Further, variation of contact area between the dresser element 212 and the polishing surface 200*a* can be corrected by the polishing cloths 262 attached to the upper surfaces of the guide tables 264.

In order to equalize abrasion speed of the polishing cloths 258 and 262, rinse nozzles 266 are provided so that the same kind of liquid and the same flow rate of liquid can be supplied to each of the polishing cloths 258 and 262. The two guide tables 264 are separately provided, and hence it is necessary to provide at least two rinse nozzles 266. For example, a supply valve and a flow meter may be formed into a single unit, and a plurality of rinse nozzles 266 may be branched from the single unit.

FIG. 27 shows a height adjusting mechanism of the guide table 264. The height adjusting mechanism comprises a bolt 270 having threads which are reverse with each other and located at upper and lower portions, and nuts 274 and 276 which are fixed to the guide table 264 and a floor 272, respectively and threaded with the threads of the bolt 270. By rotating the bolt 270 in one direction, the guide table 264 is lifted, and by rotating the bolt 270 in the opposite direction, the guide table 264 is lowered. In order to equalize abrasion speed and other conditions, the replacement of the polishing cloths 258, 262 are performed on the guide tables 264 and the polishing table 200 at the same time. That is, since a new polishing cloth has the same thickness, by using the height adjusting mechanism, the guide tables 264 are adjusted to cause the guide tables 264 to have the same height as the polishing table 200, and the same kind of polishing cloths 258, 262 are attached to the guide tables 264 and the polishing table 200, respectively, thereby equalizing the height of the polishing cloths 258, 262.

Figure 28:
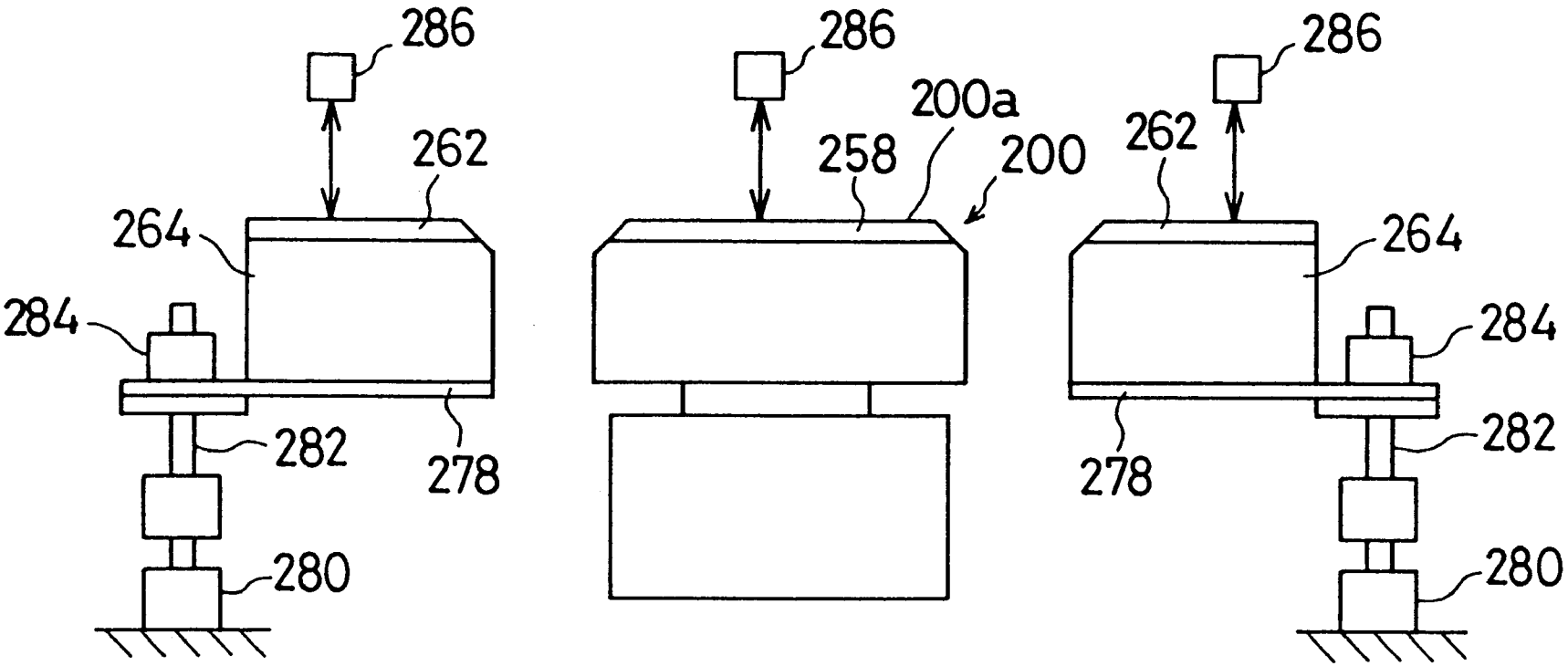
FIG. 28 is a front view of a height adjusting mechanism of a guide table in another embodiment.

FIG. 28 shows an automatic height adjusting mechanism of the guide tables 264. The automatic height adjusting mechanism comprises a pair of bases 278 to which guide tables 264 are attached, stepping motors 280, feed screws 282 rotated by the stepping motors 280, and nuts 284 into which the feed screws 282 fixed to the bases 278 are threaded, respectively. In the automatic height adjusting mechanism, the respective bases 278 are lifted or lowered. The heights of the guide tables 264 and the height of the polishing table 200 are measured by the distance measuring sensors 286 comprising a contact type sensor or a noncontact type sensor and disposed above the guide tables 264 and the polishing table 200 to measure the difference of the heights. The measured difference is converted into the number of pulses in the stepping motor 280, and the stepping motor 280 is operated by the obtained number of pulses so that the guide tables 264 and the polishing table 200 have no height difference.

Figure 29:
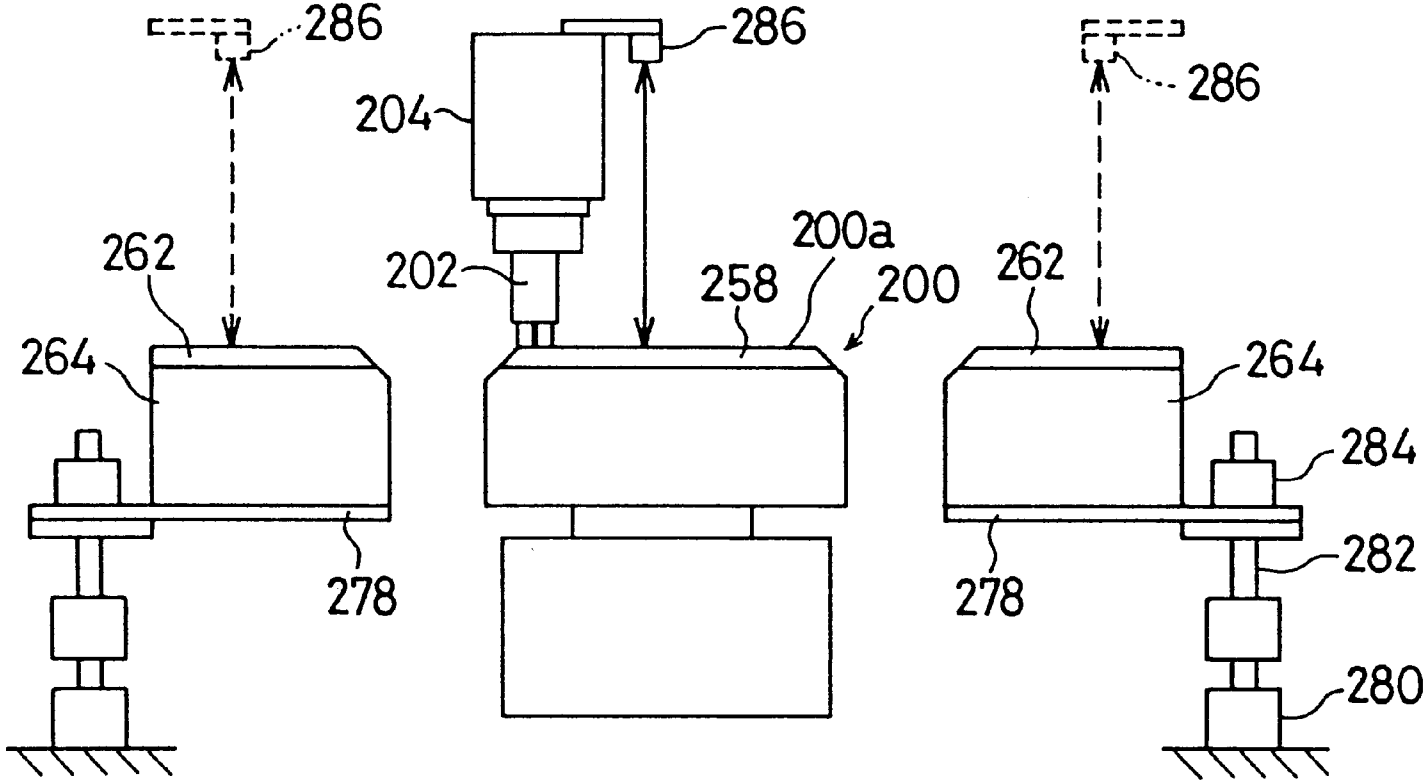
FIG. 29 is a front view of a height adjusting mechanism of a guide table in still another embodiment.

As shown in FIG. 29, a single distance measuring sensor 286 is attached to the dresser arm 204. When the dresser arm 204 moves horizontally, the sensor 286 measures the distances between the sensor 286, and the upper surfaces of the guide tables 264 or the polishing table 200 as the heights of the guide tables 264 and the height of the polishing table 200. The moving distance of the guide table 264 is determined on the basis of the measured results.

Figure 30:
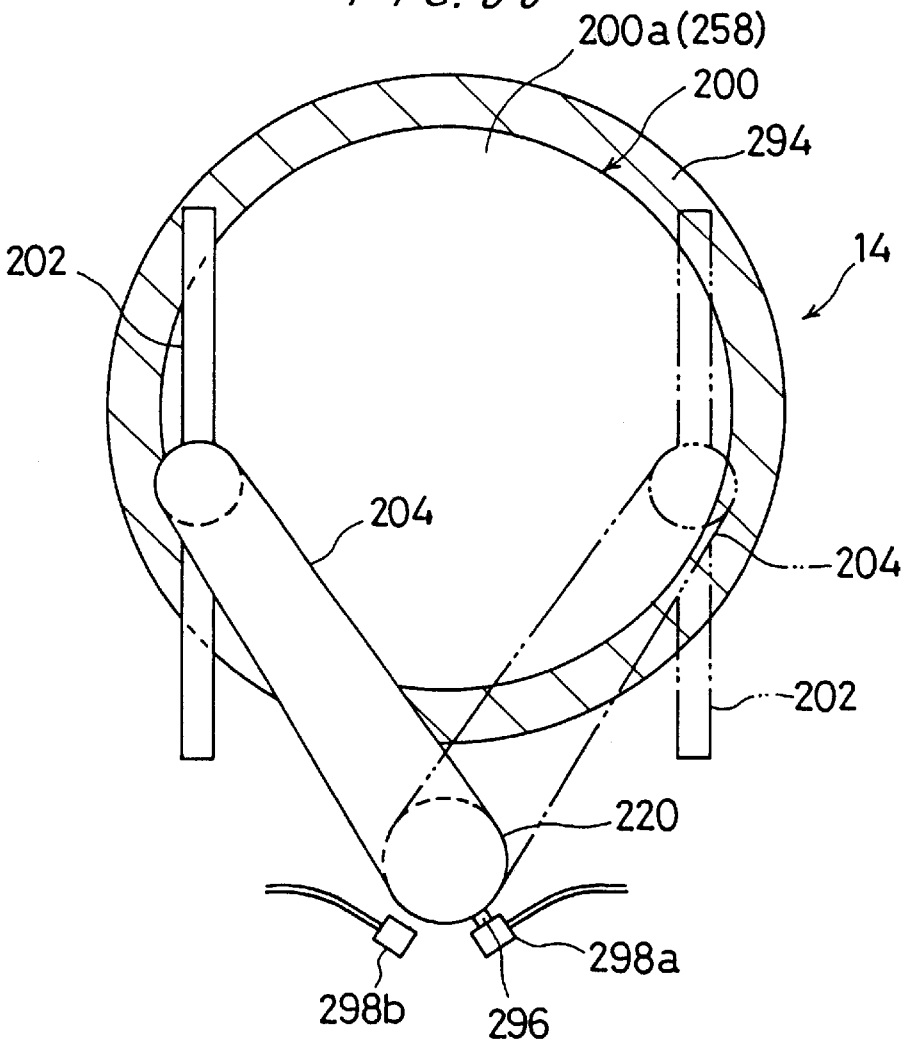
FIG. 30 is a plan view of a dressing apparatus according to a sixth embodiment of the present invention.
Figure 31:
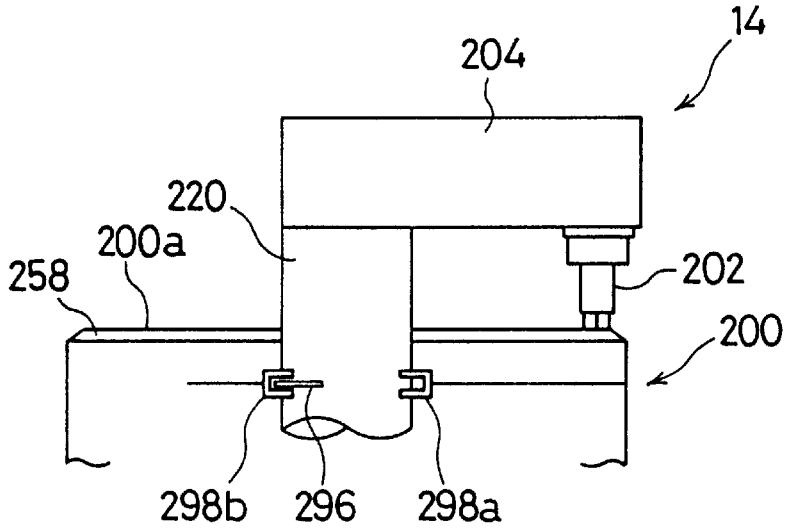
FIG. 31 is a front view of the dressing apparatus according to the sixth embodiment of the present invention.

FIGS. 30 and 31 show a dressing apparatus 14 according to a sixth embodiment of the present invention. In the dressing apparatus 14 according to this embodiment, in order to prevent the dresser 202 from falling out of the polishing table and to dress the polishing surface 200*a* of the polishing table 200 efficiently, movement of the dresser 202 is reduced as much as possible in the area 294 outside the polishing surface. That is, a sensor dog 296 is provided on the swing shaft 220, and sensors 298*a* and 298*b* are provided to detect the sensor dog 296 when the dresser 202 reaches the area 294 outside the polishing surface.

Thus, the sensors 298*a*, 298*b* detect the dresser 202 which has reached the area 294 outside the polishing surface, and, for example, by switching actuation of the cylinder, the dresser 202 is returned to the polishing surface. Thus, the dressing area is kept to a minimum. If a stepping motor is employed to move the dresser arm 204, the dresser 202 may be controlled so as to move in a minimum dressing area on the basis of the number of pulses.

Figure 32:
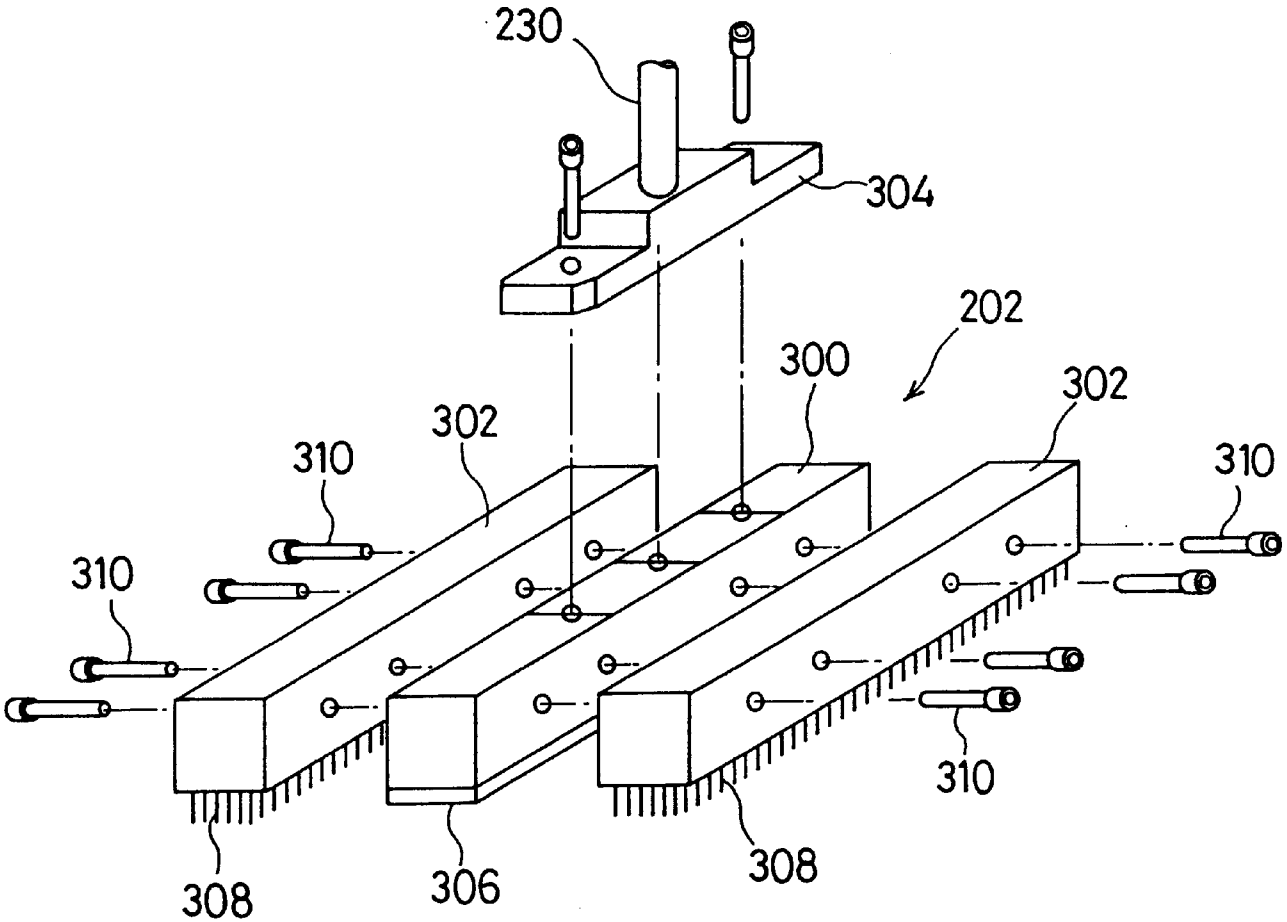
FIG. 32 is an exploded perspective view of a dresser in another embodiment.
Figure 33:
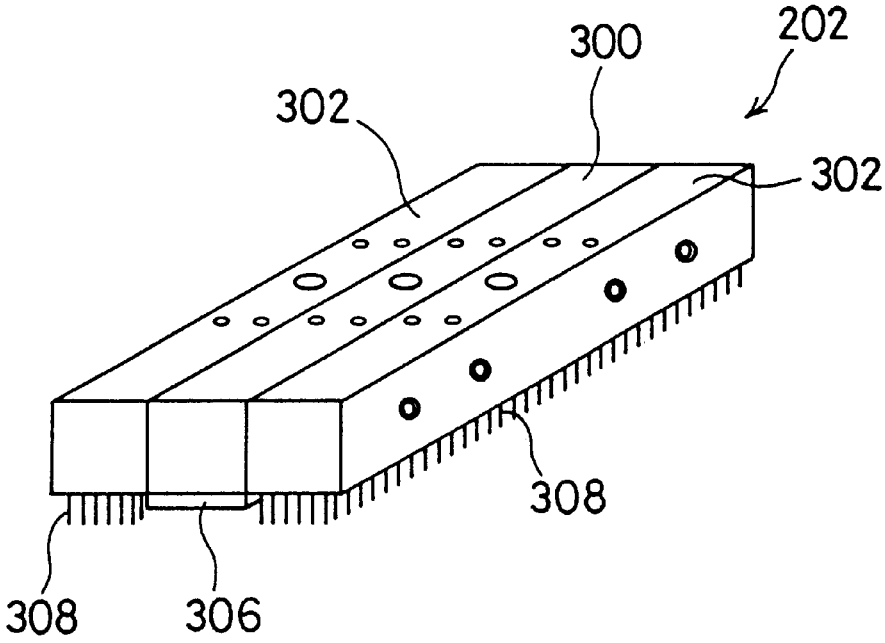
FIG. 33 is a perspective view of a dresser which incorporates a main dresser, and side dressers at both sides of the main dresser.
Figure 34:
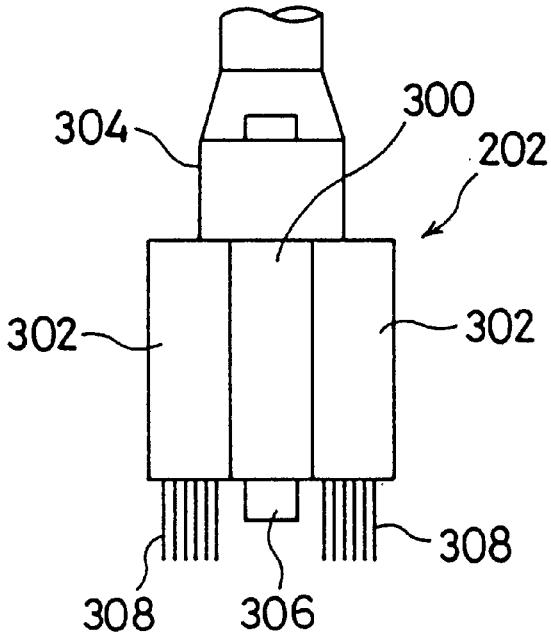
FIG. 34 is a front view of the dresser which incorporates the main dresser, and the side dressers at both sides of the main dresser.

FIGS. 32 through 34 show a dresser 202 in another embodiment. The dresser 202 comprises an elongate main dresser 300 at the central position thereof, and elongate side dressers 302 provided at both sides of the main dresser 300. In this dresser 202, a support member 304 connected to the lower end of the dresser support shaft 230 has a lower surface to which a plurality of dresser elements are attached. For example, the main dresser 300 having a hard dresser element 306 is attached to the lower surface of the support member 304, and the side dressers 302 having desired dresser elements 308 such as a soft dresser element are attached to the both sides of the main dresser 300. The characteristics of respective dresser elements 306, 308 are utilized effectively to conduct dressing of the polishing surface effectively.

In case of the polishing cloth which is dressed by the hard dresser element 306, only the main dresser 300 having the hard dresser element 306 may be used. If the side dressers 302 having the soft dresser elements 308 are added to the both sides of the main dresser 300, foreign matter generated before dressing and foreign matter generated after dressing can be simultaneously removed.

Even if the polishing cloth which is dressed by the hard dresser element 306 such as a diamond dresser is dressed by the soft dresser element 308 such as a nylon brush, although the cleanliness of the polishing surface may be improved, any other influence on the polishing cloth is not exerted. Thus, it is possible to dress the polishing cloth by the above method.

In this example, the side dresser 302 has a pin (not shown) at the side thereof, and the main dresser 300 has a recess (not shown) at the side thereof and at the position corresponding to the pin. The positioning of the main dresser 300 and the side dresser 302 are performed by fitting the pin into the recess, and the main dresser 300 and the side dresser 302 are connected to each other by bolts 310, thereby facilitating maintenance of the dresser.

Figure 35:
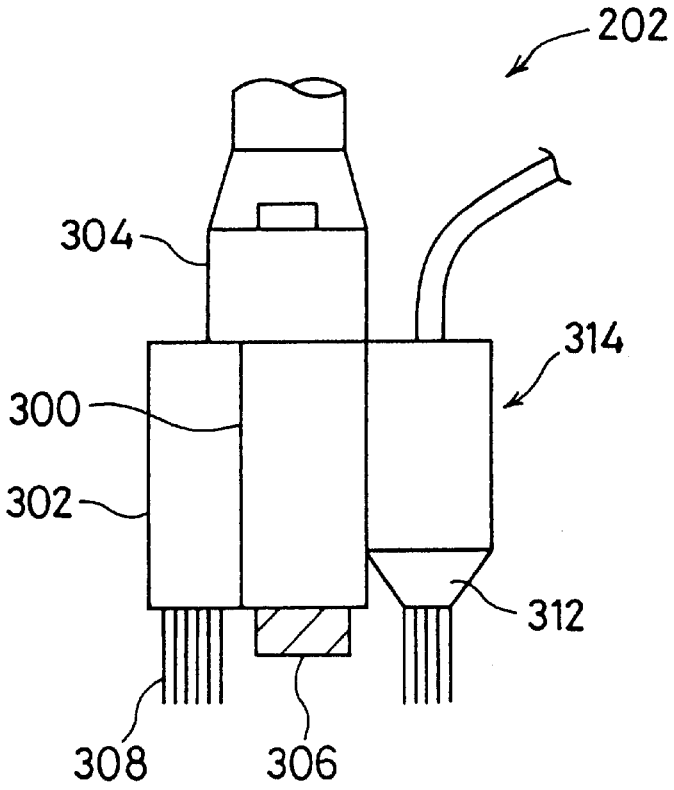
FIG. 35 is a front view of a dresser in another embodiment.

FIG. 35 shows a dresser 202 in another embodiment. The dresser 202 comprises a dresser element for dressing the polishing surface by bringing the dresser element in contact with the polishing surface, and a dressing and cleaning mechanism for dressing and cleaning the polishing surface. A side dresser 302 is provided at one side of the main dresser 300, and an ultrasonic cleaning device 314 which is a noncontact-type cleaning mechanism and has a plurality of nozzles at a certain pitch is attached to another side of the main dresser 300. The ultrasonic cleaning device 314 has the same length as the main dresser 300.

The ultrasonic cleaning device 314 removes foreign matter attached to the polishing surface by vibrating foreign matter. Thus, by providing the ultrasonic cleaning device 314, the polishing surface is cleaned by an ultrasonic cleaning process while the polishing surface is dressed, thus improving cleanliness of the polishing surface. Further, by combining the hard dressing member 306, the soft dressing member 308 and the ultrasonic cleaning device 314 freely, optimum dressing condition can be created.

Figure 36:
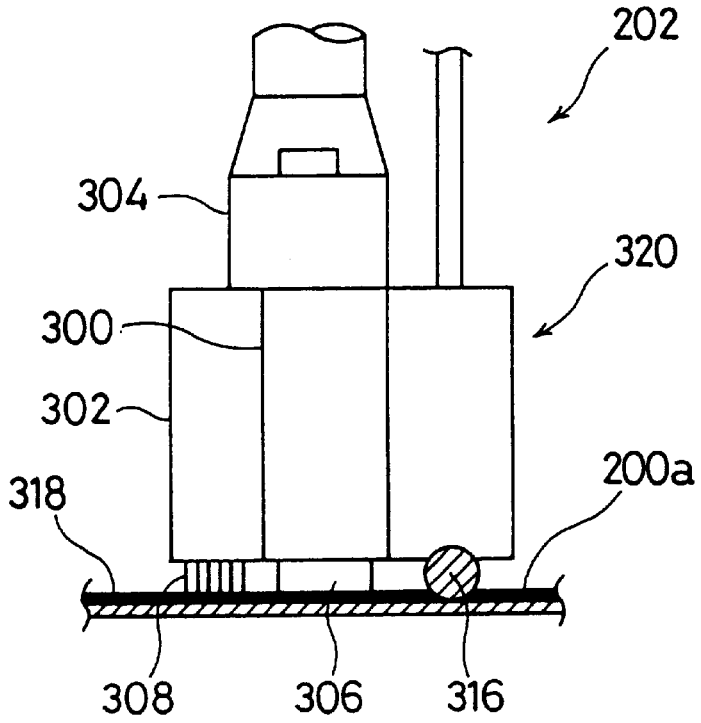
FIG. 36 is a front view of a dresser in still another embodiment.

As another embodiment of the dressing and cleaning mechanism, instead of the ultrasonic cleaning device 314, as shown in FIG. 36, a cleaning device 320 having a transducer 316 may be provided. In the cleaning device 320 having the transducer 316, a liquid 318 is interposed between the transducer 316 and the polishing surface 200*a*, and vibration of the transducer 316 is transmitted to the polishing surface 200*a* through the liquid 318, thereby vibrating foreign matter and removing the foreign matter from the polishing surface 200*a*.

Figure 37:
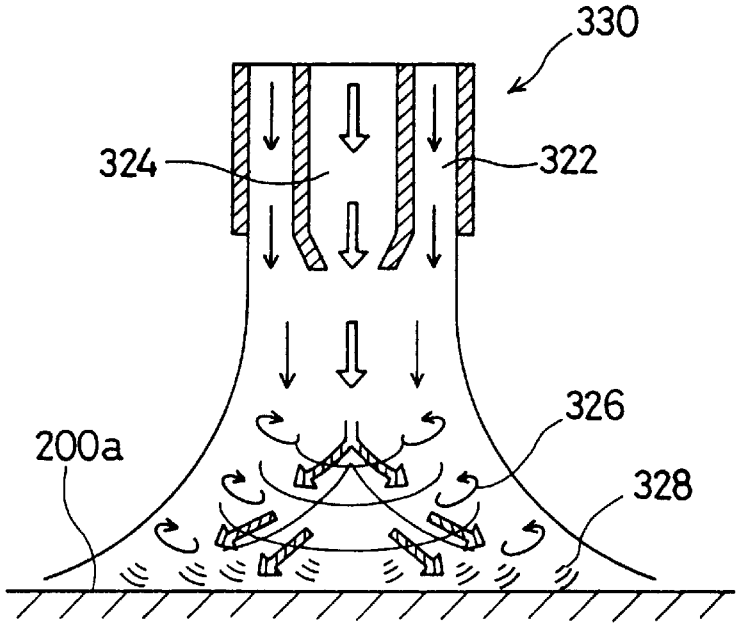
FIG. 37 is a schematic view showing the cleaning device used in the dresser and utilizing cavitation.

FIG. 37 shows a cleaning device 330. In the cleaning device 330 shown in FIG. 37, cavitation 326 is produced by ejecting high-pressure water 324 into low-pressure water 322, and the cavitation 326 is broken to generate shock waves 328 by which the polishing surface 200*a* is cleaned. The dresser may be constructed by combining the above contact type of dressing element, and the dressing and cleaning mechanism.

Figure 38:
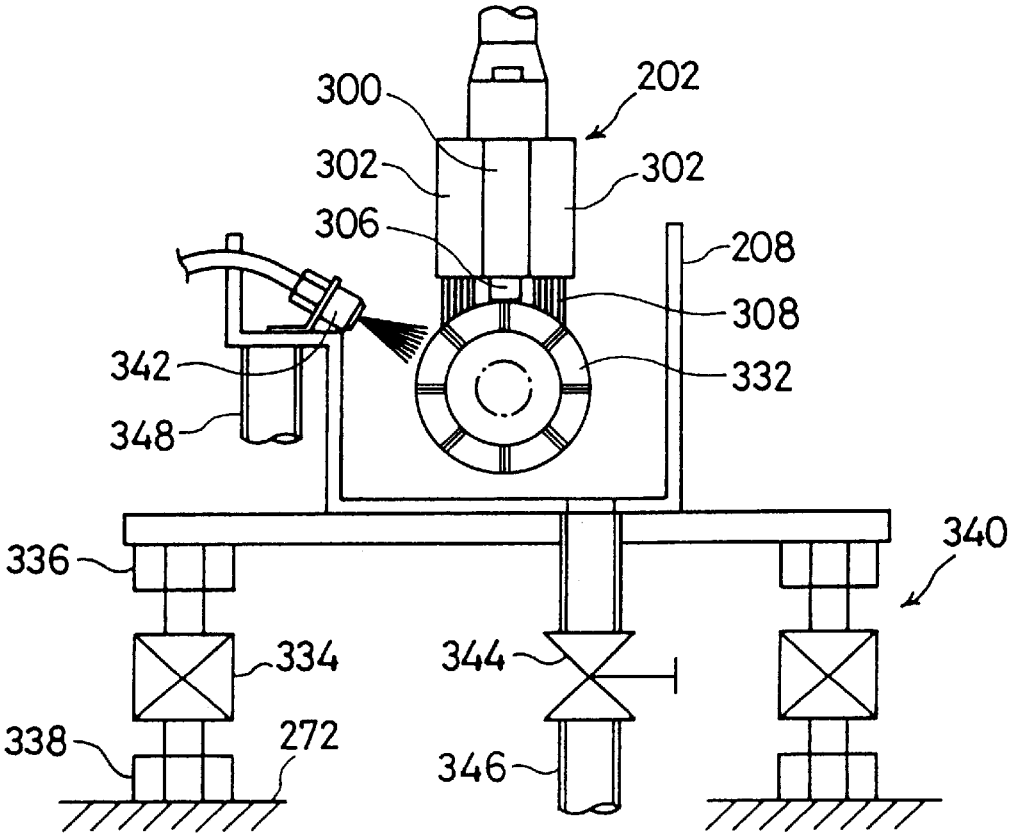
FIG. 38 is a cross-sectional view of a dresser cleaning container in another embodiment.

FIG. 38 shows another dresser cleaning container 208 which incorporates a rotating type of cleaning member. The dresser cleaning container 208 has a cleaning member 332 such as a nylon brush therein which is rotated by a motor. The cleaning member 332 rubs the lower surfaces of the dresser elements 306, 308 of the dresser 202 shown in FIGS. 32 through 34, and thus the dresser elements 306, 308 are cleaned. A rotating mechanism of the cleaning member 332 may have a water-proof structure. A height adjusting mechanism 340 comprises a bolt 334 having threads which are reverse with each other and located at upper and lower portions, and nuts 336 and 338 fixed to the dresser cleaning container 208 and a floor 272, respectively and threaded with the threads of the bolt 334. The height adjusting mechanism 340 can adjust the height of the dresser cleaning container 208, and thus the height of the cleaning member 332 for thereby adjusting a pressing amount of the dresser element against the cleaning member 332. This adjustment can be performed at the side of the dresser cleaning container. The dresser cleaning container 208 has a plurality of rinse nozzles 342 for supplying rinse water toward the cleaning member 332 in the dresser cleaning container 208 to heighten cleaning effect, and filling the dresser cleaning container 208 with water. Further, the dresser cleaning container 208 has a lower drain port 346 having a drain valve 344 which is closed when the dresser cleaning container 208 is filled with liquid, and an upper drain port 348 for overflowing liquid in the dresser cleaning container 208. The upper drain port 348 may have no valve or may have a valve which is opened in a normal condition.

In the above structure, when the dresser elements 306, 308 are cleaned, liquid in the dresser cleaning container 208 is drained from the drain ports 346, 348. Thus, foreign matter is prevented from adhering to the dresser elements 306, 308, and when contact cleaning is not performed, the drain valve 344 is closed, and then the dresser elements 306, 308 are immersed in the liquid in the dresser cleaning container 208 to prevent them from drying.

Figure 39:
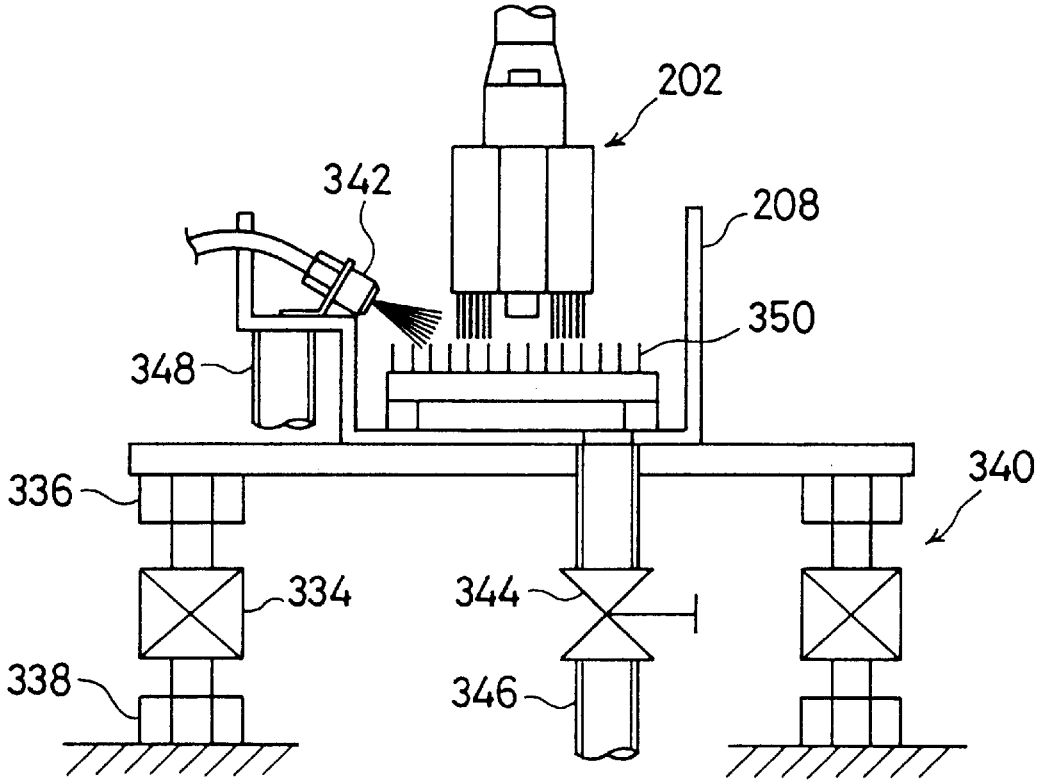
FIG. 39 is a cross-sectional view of a dresser cleaning container in still another embodiment.

FIG. 39 shows a dresser cleaning container 208 in another embodiment. Instead of the cleaning member 332 which is a rotating type shown in FIG. 38, a flat plate-shaped cleaning member 350 having a nylon brush thereon is provided in the dresser cleaning container 208. In case of the dresser 202 shown in FIGS. 32 through 34, the dresser 202 is moved horizontally, the entire lower surfaces of the dresser elements 306, 308 are rubbed by the cleaning member 350 to clean the dresser elements 306, 308. This two types of dresser cleaning containers can be filled with water to a height at which the dresser element is perfectly immersed.

Figure 40:
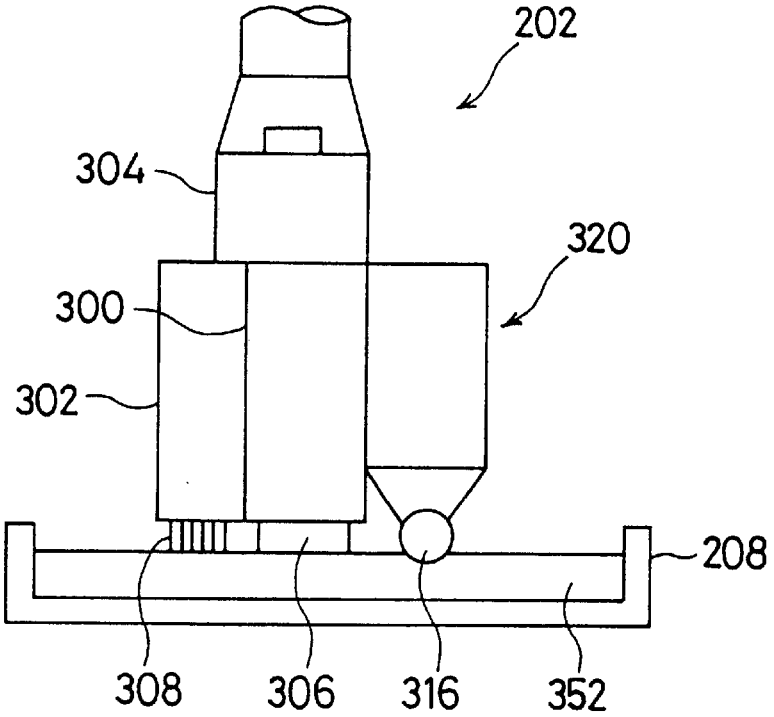
FIG. 40 is a schematic view showing the state in which the dresser shown in FIG. 36 is cleaned.

Further, in the dresser 202 having the cleaning device 320 comprising the transducer 316 shown in FIG. 36, as shown in FIG. 40, the transducer 316 is operated to apply an ultrasonic vibration to liquid 352, and the dresser elements 306, 308 of the dresser 202 which are immersed in liquid 352 are cleaned. In this case, the dresser may be cleaned by utilizing vibration of ultrasonic transducer provided on the dresser. However, as shown in FIG. 14, an ultrasonic transducer is provided in the dresser cleaning container, and the dresser may be cleaned by vibration caused by the ultrasonic transducer.

Figure 41:
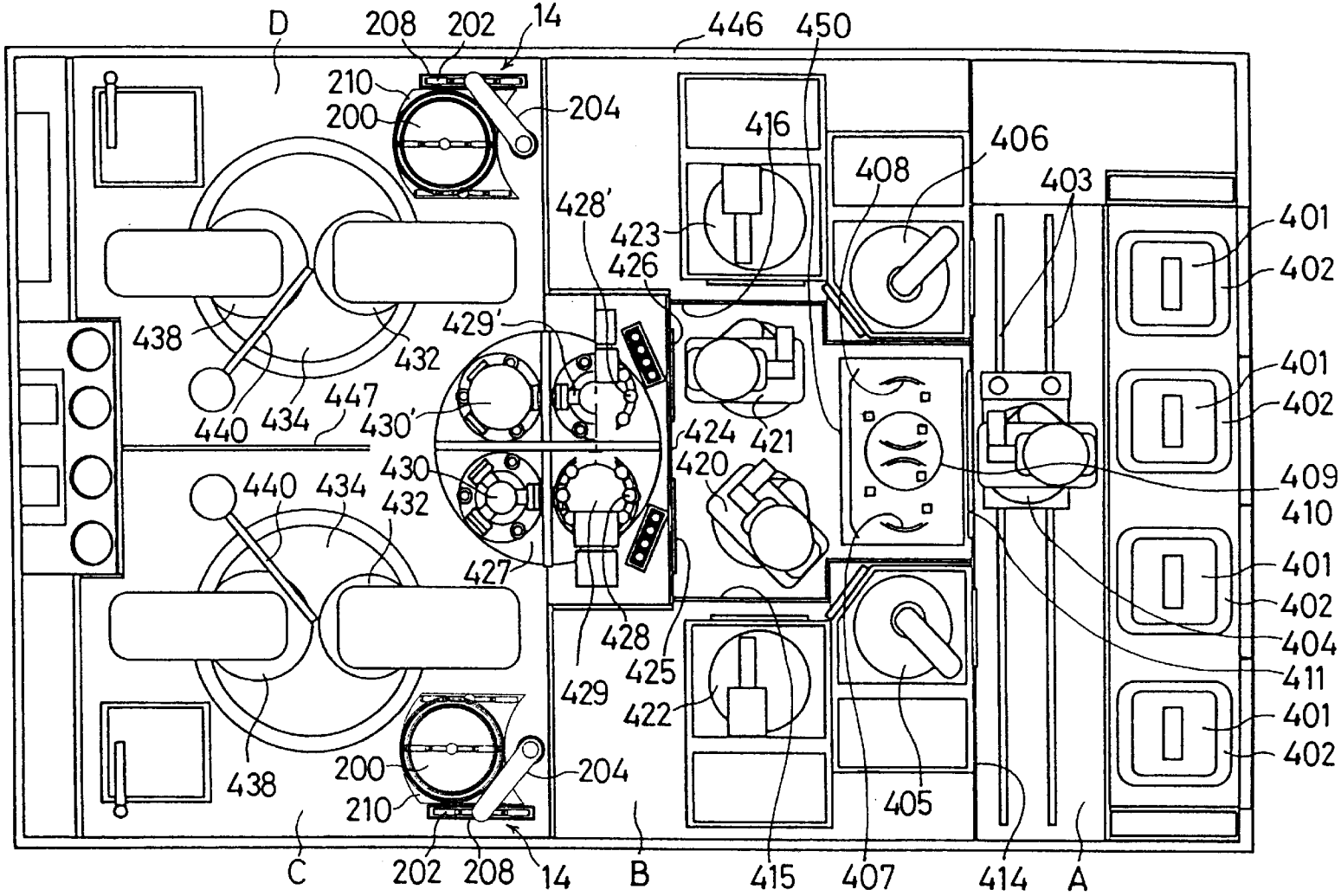
FIG. 41 is a plan view of a polishing apparatus having a dressing apparatus shown in FIGS. 17 through 23.

FIG. 41 is a plan view of a polishing apparatus having the dressing apparatus 14 shown in FIGS. 17 through 23. As shown in FIG. 41, a polishing apparatus according to the present invention comprises four load-unload stages 402 each for placing a wafer cassette 401 which accommodates a plurality of semiconductor wafers. The load-unload stage 402 may have a mechanism for raising and lowering the wafer cassette 401. A transfer robot 404 having two hands is provided on rails 403 so that the transfer robot 404 can move along the rails 403 and access the respective wafer cassettes 401 on the respective load-unload stages 402.

Two cleaning apparatuses 405 and 406 are disposed at the opposite side of the wafer cassettes 401 with respect to the rails 403 of the transfer robot 404. The cleaning apparatuses 405 and 406 are disposed at positions that can be accessed by the hands of the transfer robot 404. Between the two cleaning apparatuses 405 and 406 and at a position that can be accessed by the transfer robot 404, there is provided a wafer station 450 having four wafer supports 407, 408, 409 and 410. The cleaning apparatuses 405 and 406 have a spin-dry mechanism for drying a semiconductor wafer by spinning the semiconductor wafer at a high speed, and hence the two-stage cleaning or three-stage cleaning of the semiconductor wafer can be conducted without replacing any cleaning module.

An area B in which the cleaning apparatuses 405 and 406 and the wafer station 450 having the wafer supports 407, 408, 409 and 410 are disposed and an area A in which the wafer cassettes 401 and the transfer robot 404 are disposed are partitioned by a partition wall 414 so that the cleanliness of the area B and the area A can be separated. The partition wall 414 has an opening for allowing semiconductor wafers to pass therethrough, and a shutter 411 is provided at the opening of the partition wall 414. A transfer robot 420 having two hands is disposed at a position where the transfer robot 420 can access the cleaning apparatus 405 and the three wafer supports 407, 409 and 410, and a transfer robot 421 having two hands is disposed at a position where the transfer robot 421 can access the cleaning apparatus 406 and the three wafer supports 408, 409 and 410.

The wafer support 407 is used to transfer a semiconductor wafer between the transfer robot 404 and the transfer robot 420. The wafer support 408 is used to transfer a semiconductor wafer between the transfer robot 404 and the transfer robot 421. The wafer support 409 is used to transfer a semiconductor wafer from the transfer robot 421 to the transfer robot 420. The wafer support 410 is used to transfer a semiconductor wafer from the transfer robot 420 to the transfer robot 421.

A cleaning apparatus 422 is disposed at a position adjacent to the cleaning apparatus 405 and accessible by the hands of the transfer robot 420, and another cleaning apparatus 423 is disposed at a position adjacent to the cleaning apparatus 406 and accessible by the hands of the transfer robot 421.

All the cleaning apparatuses 405, 406, 422 and 423, the wafer supports 407, 408, 409 and 410 of the wafer station 450, and the transfer robots 420 and 421 are placed in the area B. The pressure in the area B is adjusted so as to be lower than the pressure in the area A. Each of the cleaning apparatuses 422 and 423 is capable of cleaning both surfaces of a semiconductor wafer.

The polishing apparatus has a housing 446 for enclosing various components therein. The housing 446 constitutes an enclosing structure. The interior of the housing 446 is partitioned into a plurality of compartments or chambers (including the areas A and B) by partitions 414, 415, 416, 424 and 447.

A polishing chamber separated from the area B by the partition wall 424 is formed, and is further divided into two areas C and D by the partition wall 447. In each of the two areas C and D, there are provided two polishing tables comprising a polishing table 434 for performing a rotational motion and a polishing table 200 for performing a scroll motion as shown in FIGS. 18 and 19, and a top ring 432 for holding a semiconductor wafer and pressing the semiconductor wafer against the polishing tables 434, 200. A polishing liquid nozzle 440 for supplying a polishing liquid to the polishing table 434 and a dresser 438 for dressing the polishing table 434 are provided in each of the two areas C and D. Further, the dressing apparatus 14 shown in FIGS. 19 through 23, for dressing the polishing table 200 is disposed in each of the areas C and D.

Figure 42:
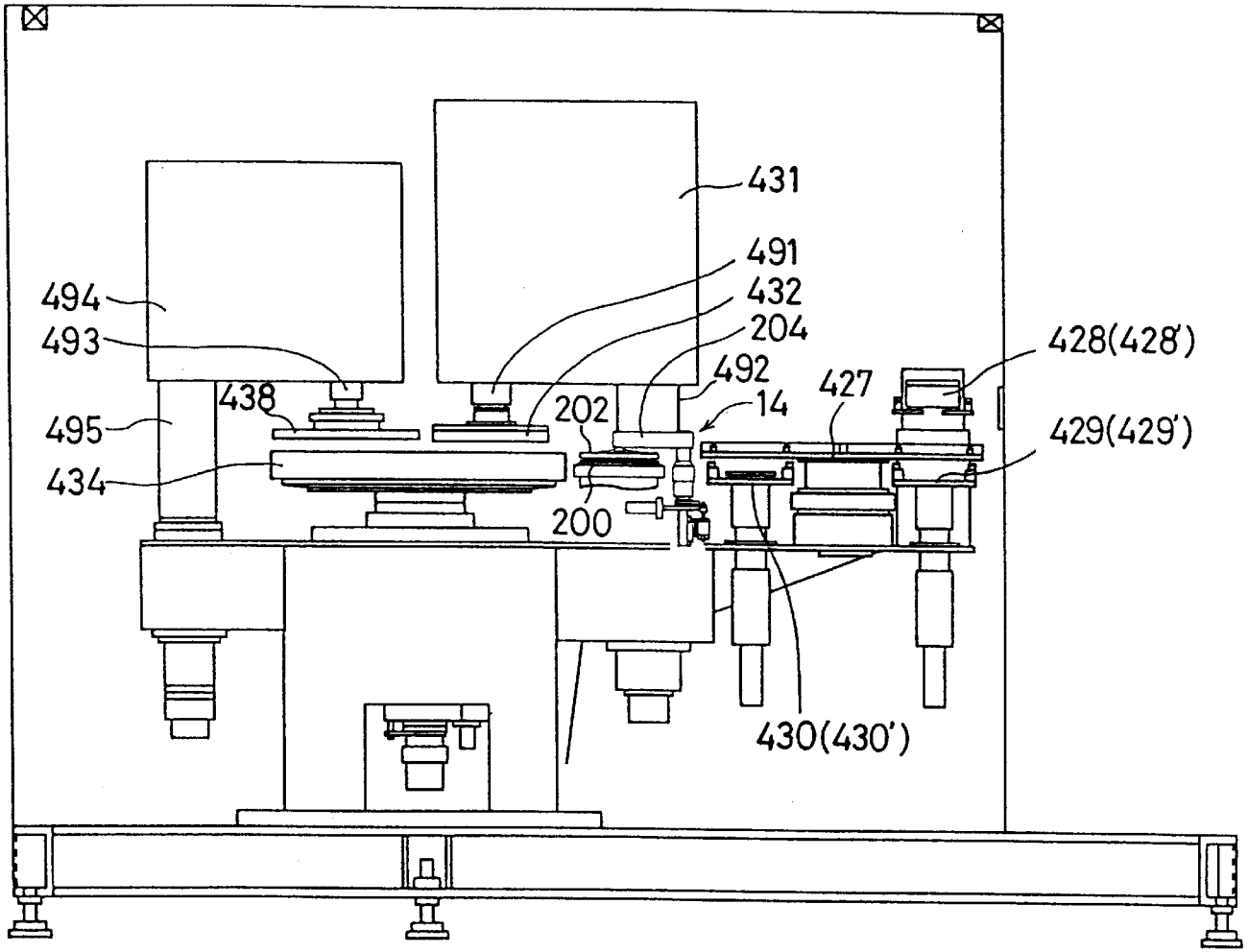
FIG. 42 is a front view showing the relationship between the top ring and the polishing table shown in FIG. 41.
Figure 43:
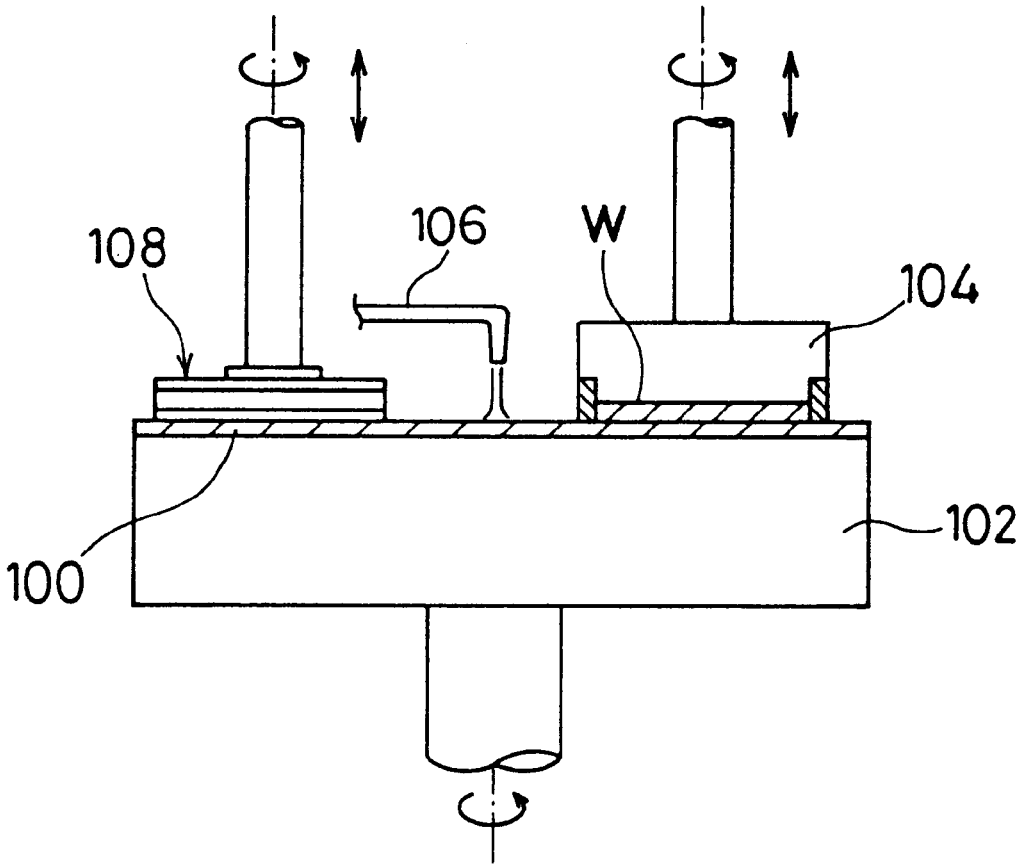
FIG. 43 is a cross-sectional view of a conventional polishing apparatus.

FIG. 42 shows the relationship between the top ring 432 and the polishing tables 434 and 200. As shown in FIG. 42, the top ring 432 is supported from a top ring head 431 by a top ring drive shaft 491 which is rotatable. The top ring head 431 is supported by a support shaft 492 which can be angularly positioned, and the top ring 432 can access the polishing tables 434 and 200. The dresser 438 is supported from a dresser head 494 by a dresser drive shaft 493 which is rotatable. The dresser head 494 is supported by an angularly positionable support shaft 495 for moving the dresser 438 between a standby position and a dressing position over the polishing table 434. The polishing table 434 and the dresser 438 rotate about their own axes. The dressing apparatus 14 comprises a dresser 202 which is translated along the polishing surface of the polishing table 200 having a scroll motion and dresses the polishing surface of the polishing table 200, and a dresser cleaning container 208 for cleaning the dresser 202.

As shown in FIG. 41, in the area C separated from the area B by the partition wall 424 and at a position that can be accessed by the hands of the transfer robot 420, there is provided a reversing device 428 for reversing a semiconductor wafer, and at a position that can be accessed by the hands of the transfer robot 421, there is provided a reversing device 428' for reversing a semiconductor wafer.

A rotary transporter 427 is disposed below the reversing devices 428 and 428' and the top rings 432, for transferring semiconductor wafers between the cleaning chamber (area B) and the polishing chamber (areas C and D). The rotary transporter 427 has four stages for placing a semiconductor wafer at equal angular intervals, and can hold a plurality of semiconductor wafers thereon at the same time. The semiconductor wafer which has been transported to the reversing device 428 or 428' is transferred to the rotary transporter 427 by actuating a lifter 429 or 429' disposed below the rotary transporter 427 when the center of the stage of the rotary transporter 427 is aligned with the center of the semiconductor wafer held by the reversing device 428 or 428'. The semiconductor wafer placed on the stage of the rotary transporter 427 is transported to a position below the top ring 432 by rotating the rotary transporter 427 by an angle of 90°. At this time, the top ring 432 is positioned above the rotary transporter 427 beforehand by a swing motion thereof. The semiconductor wafer is transferred from the rotary transporter 427 to the top ring 432 by actuating a pusher 430 or 430' disposed below the rotary transporter 427 when the center of the top ring 432 is aligned with the center of the semiconductor wafer placed on the stage of the rotary transporter 427.

The semiconductor wafer transferred to the top ring 432 is held under vacuum by a vacuum attraction mechanism of the top ring 432, and transported to the polishing table 434. Thereafter, the semiconductor wafer is polished by a polishing surface comprising a polishing cloth or an abrading plate (fixed abrasive plate) attached on the polishing table 434. The second polishing table 200 for performing a scroll motion is disposed at a position that can be accessed by the top rings 432. With this arrangement, a primary polishing of the semiconductor wafer can be conducted by the polishing table 434, and then a secondary polishing of the semiconductor wafer can be conducted by the second polishing table 200. Alternatively, the primary polishing of the semiconductor wafer can be conducted by the second polishing table 200, and then the secondary polishing of the semiconductor wafer can be conducted by the first polishing table 434. In this case, since the second polishing table 200 has a smaller-diameter polishing surface than the first polishing table 434, an abrading plate (fixed abrasive plate) which is more expensive than a polishing cloth is attached to the second polishing table 200 to thereby conduct a primary polishing of the semiconductor wafer. On the other hand, the polishing cloth having a shorter life but being cheaper than the abrading plate (fixed abrasive plate) is attached to the first polishing table 434 to thereby conduct a finish polishing of the semiconductor wafer. This arrangement or utilization may reduce the running cost of the polishing apparatus. If the polishing cloth is attached to the first polishing table and the abrading plate (fixed abrasive plate) is attached to the second polishing table, then the polishing table system may be provided at a lower cost. This is because the abrading plate (fixed abrasive plate) is more expensive than the polishing cloth, and the price of the abrading plate (fixed abrasive plate) is substantially proportional to the diameter of the abrading plate. Further, since the polishing cloth has a shorter life than the abrading plate (fixed abrasive plate), if the polishing cloth is used under a relatively light load such as a finish polishing, then the life of the polishing cloth is prolonged. Further, if the diameter of the polishing cloth is large, the chance or frequency of the contact with the semiconductor wafer is distributed to thus provide a longer life, a longer maintenance period, and an improved productivity of the semiconductor devices.

After a semiconductor wafer is polished by the first polishing table 434 and before the top ring 432 moves to the second polishing table 200, a cleaning liquid is supplied from cleaning liquid nozzles 440 disposed adjacent to the polishing table 434 to the semiconductor wafer held by the top ring 432 at a position where the top ring 432 is spaced from the polishing table 434. Because the semiconductor wafer is rinsed before moving to the second polishing table 200, the transfer of contamination between the polishing tables is prevented to thus avoid cross contamination of the polishing tables.

As an example of flow of the substrates (semiconductor wafers) when the substrates are polished in the polishing apparatus shown in FIG.41, two cassette parallel processing will be described.

One semiconductor wafer is processed in the following route: the wafer cassette 401→the transfer robot 404→the wafer support 407 of the wafer station→the transfer robot 420→the reversing device 428→the wafer stage for loading in the rotary transporter 427→the top ring 432→the polishing table 434→the top ring 432→the wafer stage for unloading in the rotary transporter 427→the reversing device 428→the transfer robot 420→the cleaning apparatus 422→the transfer robot 420→the cleaning apparatus 405→the transfer robot 404→the wafer cassette 401.

The other semiconductor wafer is processed in the following route: the wafer cassette 401→the transfer robot 404→the wafer support 408 of the wafer station→the transfer robot 421→the reversing device 428'→the wafer stage for loading in the rotary transporter 427→the top ring 432→the polishing table 434→the top ring 432→the wafer stage for unloading in the rotary transporter 427→the reversing device 428'→the transfer robot 421→the cleaning apparatus 423→the transfer robot 421→the cleaning apparatus 406→the transfer robot 404→the wafer cassette 401.

As described above, according to the dressing apparatus of the present invention, the entire area of the polishing surface can be simultaneously dressed, and hence the polishing surface of the polishing table can be efficiently and uniformly regenerated over its entire area.

Further, by using the elongate dresser which can be moved horizontally, and a dresser cleaning container having a shape corresponding to the shape of the dresser, the polishing table which makes a scroll motion and has an advantage of saving space can be reliably dressed by the dresser which occupies a small installation area, and a processing capability per unit area of the polishing table can be improved.

Further, a plurality of dresser elements can be easily selected, and different kinds of dresser elements can be freely combined and simultaneously used to improve the dresser capability. Further, by cleaning the dresser element in the dresser cleaning container, foreign matter attached to the dresser element and fragments of the dresser element can be prevented from being attached to the polishing surface.

Although certain preferred embodiments of the present invention have been shown and described in detail, it should be understood that various changes and modifications may be made therein without departing from the scope of the appended claims.

What is claimed is:

1. A dressing apparatus for dressing a polishing surface of a polishing table for polishing a surface of a workpiece, the dressing apparatus comprising:

a dresser having a dressing surface for dressing said polishing surface;

a sensor for detecting a frictional load between said polishing surface and said dressing surface directly or indirectly; and a judgment device for judging whether dressing of said polishing surface progresses to a predetermined degree on the basis of an output of said sensor.

2. A dressing apparatus according to claim 1 wherein said sensor comprises a motor current detector for detecting current of at least one of a motor for rotating said polishing table and a motor for rotating said dresser.

3. A dressing apparatus for dressing a polishing surface of a polishing table for polishing a surface of a workpiece, the dressing apparatus comprising:

a dresser having a dressing surface for dressing said polishing surface, said dressing surface having a dimension in one direction which is longer than a dimension in said direction of a moving area of said polishing surface;

a moving mechanism for moving said dresser horizontally along said polishing surface; and a prevention mechanism provided around the polishing surface of the polishing table for preventing said dresser from moving in a direction perpendicular to said polishing surface.

4. A dressing apparatus according to claim 3, wherein said prevention mechanism comprises a guide table provided around said polishing surface for supporting at least part of said dressing surface.

5. A dressing apparatus according to claim 3, wherein said prevention mechanism comprises a position detecting device for detecting a position of said dresser.

6. A dressing apparatus according to claim 3, further comprising a control mechanism for controlling a pressing amount of said dresser against said polishing surface.

7. The dressing apparatus according to claim 4 wherein a surface of said guide table and said polishing surface are flush with each other.

8. A dressing apparatus according to claim 6, wherein said control mechanism comprises a lifting/lowering cylinder and a stopper for determining a position of said dresser.

9. A dressing apparatus according to claim 3, wherein said polishing table performs no rotational motion about its own axis during dressing.

10. A dressing apparatus according to claim 3, wherein a moving velocity of said polishing surface is equal at every point on said polishing surface.

11. A dressing apparatus according to claim 3, wherein said polishing table makes a circulative translational motion.

12. A dressing apparatus according to claim 3, wherein the entire said moving area of said polishing surface is defined by an outer periphery of said polishing surface which makes said circulative translational motion.

13. A dressing apparatus according to claim 3, wherein said dresser performs no rotational motion about its own axis during dressing.

14. A dressing apparatus according to claim 3, wherein said moving mechanism comprises a translation mechanism for causing said dresser to perform a translation along said polishing surface.

15. A dressing apparatus according to claim 14, wherein said translation of said dresser is in a direction perpendicular to said one direction defining said dimension of said dresser.

16. A dressing apparatus according to claim 3, further comprising a dresser cleaning container for cleaning said dressing surface.

17. A dressing apparatus according to claim 3, wherein said dresser comprises a cylindrical roller which rotates about an axis parallel to said polishing surface and has a dressing surface on its outer circumferential surface.

18. A dressing apparatus for dressing a polishing surface of a polishing table for polishing a surface of a workpiece, the dressing apparatus comprising:

a dresser having a dressing surface for dressing said polishing surface; and a dresser cleaning container for cleaning said dressing surface, said dresser cleaning container comprising:

a main cleaning container for receiving said dresser;

a cleaning liquid supply device for supplying a cleaning liquid to said main cleaning container;

a receiving container for receiving the cleaning liquid flowing out of said main cleaning container;

a drain hole provided in said receiving container for discharging the cleaning liquid from said receiving container;

an ultrasonic transducer for cleaning said dressing surface by ultrasonic vibration; and a scrubbing member for scrubbing said dressing surface.

19. A dressing apparatus according to claim 18, wherein said dressing cleaning container comprises said scrubbing member which comprises a brush.

20. A dressing apparatus according to claim 18, wherein said dresser is immersed in said cleaning liquid in said container, wherein a content volume of said container is 1.5 to 2.5 times larger than a volume of an immersed part of said dresser immersed in said cleaning liquid in said container.

21. A dressing apparatus according to claim 18, wherein said dresser comprises a diamond dresser.

22. A dressing apparatus according to claim 18 wherein said dresser comprises a brush.

23. A dressing apparatus according to claim 18, wherein said scrubbing member is rotated by a motor.

* * * * *